US011744372B2

(12) United States Patent
Kawaguchi

(10) Patent No.: US 11,744,372 B2
(45) Date of Patent: Sep. 5, 2023

(54) STRETCH FUNCTION-ADDED LOADING SHEET, AND CHAIR PROVIDED HEREWITH

(71) Applicant: Kiyoshi Kawaguchi, Fukuoka (JP)

(72) Inventor: Kiyoshi Kawaguchi, Fukuoka (JP)

( * ) Notice: Subject to any disclaimer, the term of this patent is extended or adjusted under 35 U.S.C. 154(b) by 98 days.

(21) Appl. No.: 17/610,594

(22) PCT Filed: Apr. 16, 2020

(86) PCT No.: PCT/JP2020/016676
§ 371 (c)(1),
(2) Date: Nov. 11, 2021

(87) PCT Pub. No.: WO2020/241107
PCT Pub. Date: Dec. 3, 2020

(65) Prior Publication Data

US 2022/0232980 A1 Jul. 28, 2022

(30) Foreign Application Priority Data

May 24, 2019 (JP) ..... 2019-098150

(51) Int. Cl.
*A47C 7/28* (2006.01)
*B42F 1/00* (2006.01)
(Continued)

(52) U.S. Cl.
CPC ..... *A47C 7/282* (2013.01); *A45F 3/26* (2013.01); *A47C 5/06* (2013.01); *A47C 31/023* (2013.01);
(Continued)

(58) Field of Classification Search
CPC ..... A47C 7/282; A47C 5/06; A47C 31/023; A45F 3/26; Y10T 24/202; Y10T 24/203; B42F 1/006
See application file for complete search history.

(56) References Cited

U.S. PATENT DOCUMENTS 4,332,060 A * 6/1982 Sato ..... B43M 99/009 24/456
4,532,680 A * 8/1985 Hashimoto ..... B42F 1/02 24/67.5
(Continued)

FOREIGN PATENT DOCUMENTS

JP H07-144383 6/1995
JP 3185845 9/2013
(Continued)

OTHER PUBLICATIONS

Onway (OW-61BD-BM), https://www.onway.jp/products_chairs/32_index_detail_shtml, 3 pages.
(Continued)

*Primary Examiner* — Rodney B White
(74) *Attorney, Agent, or Firm* — Rankin, Hill & Clark LLP

(57) ABSTRACT

This stretch function-added loading sheet is provided with one sheet body and a force crimping unit. The force crimping unit comprises two clamping block plates and one clamping jig, and on one surface of the sheet body, the two clamping block plates are fixed on both sides of a folding centerline on the sheet body. In a state in which the sheet body is folded along the folding centerline such that the two clamping block plates overlap each other with the sheet body on the inside, the clamping jig is fixed to the two clamping block plates so as to clamp the two clamping block plates. The stretch function-added loading sheet has a stretch function with which the sheet body stretches by the clamping jig opening through application of a tensile force perpendicular to the folding centerline to the sheet body, and shrinks when said tensile force is reduced.

20 Claims, 27 Drawing Sheets

(51) Int. Cl.
*A45F 3/26* (2006.01)
*A47C 5/06* (2006.01)
*A47C 31/02* (2006.01)

(52) U.S. Cl.
CPC ..... *B42F 1/006* (2013.01); *Y10T 24/202* (2015.01); *Y10T 24/203* (2015.01)

(56) References Cited

U.S. PATENT DOCUMENTS 4,735,438 A * 4/1988 Demarest, Jr. ..... B42D 9/00 24/67.5
4,761,862 A * 8/1988 Hiromori ..... B42F 1/04 40/658
5,806,147 A * 9/1998 Sato ..... B42F 1/04 24/67.5
5,950,283 A * 9/1999 Sato ..... B42F 1/006 24/67.5
6,327,749 B1 * 12/2001 Antinone ..... B42F 1/006 24/67.5
6,732,419 B2 * 5/2004 Davis ..... B42F 1/006 29/243.57
6,745,805 B2 * 6/2004 Thomson ..... A45C 1/06 150/147
7,264,285 B1 * 9/2007 Ross ..... E05B 13/002 70/447
7,318,293 B2 * 1/2008 Ardern, II ..... G09F 7/02 40/658
7,536,753 B2 * 5/2009 Thomson ..... B42F 1/006 150/132
7,577,264 B2 * 8/2009 Caploon ..... H04R 1/028 24/3.12
7,922,207 B2 * 4/2011 Hoarau ..... B42F 9/008 24/456
8,050,429 B2 * 11/2011 Caploon ..... H04R 1/028 24/67.1
9,199,506 B2 * 12/2015 Lim ..... B42F 1/006
9,511,615 B2 * 12/2016 Isserstedt ..... B42F 1/006
11,202,494 B2 * 12/2021 Kawaguchi ..... A45F 3/22
2001/0032376 A1 * 10/2001 Payne ..... B42F 1/006 24/67.5
2004/0040122 A1 * 3/2004 Huang ..... B42F 1/006 24/67.5
2009/0229084 A1 * 9/2009 Thomson ..... B42F 1/006 24/67.5
2014/0084575 A1 3/2014 Hoarau et al.
2020/0315326 A1 10/2020 Kawaguchi

FOREIGN PATENT DOCUMENTS

JP 2017-196436 11/2017
JP 3216717 6/2018
JP 3219730 1/2019
JP 2019-062994 4/2019
WO 2019/107283 6/2019

OTHER PUBLICATIONS

Written Opinion of the International Searching Authority dated Jun. 30, 2020 filed in PCT/JP2020/016676, 4 pages.
International Search Report, dated Jun. 30, 2020, 2 pages.

* cited by examiner

Step3

DETAIL A

PERSPECTIVE VIEW

THREE-PLANE DRAWING

PERSPECTIVE VIEW

THREE-PLANE DRAWING

PERSPECTIVE VIEW

THREE-PLANE DRAWING

THREE-PLANE DRAWING

PERSPECTIVE VIEW

THREE-PLANE DRAWING

DETAIL A

STRETCH FUNCTION-ADDED LOADING SHEET, AND CHAIR PROVIDED HEREWITH

TECHNICAL FIELD

The present invention pertains to a stretch function-added loading sheet, and a chair comprising the same.

BACKGROUND ART

As devices for placing a person or an object on a single sheet, devices, such as a chair using a sheet for the seating surface, etc. (see Patent Document 1), and a hammock formed by suspending a single sheet by strings, etc. (see Patent Document 2), are known. Fabrics with good air permeability are widely used for such sheet materials.

As the first requirement of a container for loading an object, etc., a sufficient strength is required to withstand the weight of the object, etc. to be loaded. Wooden boards, metal boards, metal mesh, cardboard, etc. are generally used as the main material of such a container for satisfying the required strength. As the second requirement of a container for loading an object, etc., certain elasticity is required for the purpose of improving comfort when a person is placed thereon or preventing a loaded object from being damaged due to jolts caused when the container is moved. In addition, there is also required an effect of increasing the contacting area between the container and the object placed and thereby reducing the distribution of load applied to each portion of the object placed (the load applied per unit contact area), which is achieved by having the shape of the container conform to the shape of each of various objects placed in any location in the container (shape conformability). The shape conformability also provides the effect of suppressing the slippage of the loaded object. However, the required elasticity and shape conformability cannot be obtained solely by the above-mentioned main material of the container. Accordingly, in some cases, a cushioning material, such as wadding, springs, an air cushion, or Styrofoam, is placed between the main material and the loaded object. It tends to be thought that a typical general-purpose sheet has sufficiently elasticity. However, when using only a single sheet for a container for loading an object, provided that the weight of the object to be loaded is approximately the same as the weight of a person, and that the sheet material is a general-purpose sheet having a thickness of approximately 1 mm or less, it is hardly possible to find such a sheet material satisfying the required strength and elasticity. As a sheet is a continuous flexible membrane, the form of the sheet is determined only by the frame or the suspension fulcrums for fixing the sheet and the object to be loaded, and thus a single sheet does not have much shape conformability to correspond to variations in the shape or the location of the object to be loaded. Conventionally used chairs, hammocks, etc. do not have adequate elasticity and shape conformability, and have a problem of comfort when a person is placed thereon, and thus such conventional ones have not been widely used in general households.

Meanwhile, as a sheet of which elasticity, stretchability, etc. are considered, a sheet to which stretchability is imparted by using a fibrous stretchable material has been invented (see Patent Document 3). However, the stretchable sheet described in Patent Document 3 requires the sheet itself to be made of stretchable fibers, etc., and thus this is not a technique capable of imparting stretchability, etc. to a general-purpose sheet.

PRIOR ART DOCUMENTS

Patent Documents

Patent Document 1: JP 3185845U
Patent Document 2: JP 2017-196436A
Patent Document 3: H07-144383A

SUMMARY OF THE INVENTION

Problem to be Solved by the Invention

The present invention is made based on the foregoing considerations, and it is an object of the invention to provide a stretch function-added loading sheet that has elasticity regardless of the material of the sheet body itself, and a chair comprising such a stretch function-added loading sheet.

Means for Solving the Problem

One aspect of the present invention made for solving the above-mentioned problem is: a stretch function-added loading sheet, comprising one sheet body, and any number of forced crimping units, the forced crimping unit including two pinching block plates and one pinching jig, wherein the two pinching block plates are fixed on one surface of the sheet body on both sides of a folding centerline on the sheet body; the pinching jig is fixed to the two pinching block plates so as to sandwich the two pinching block plates in a state where the sheet body is folded along the folding centerline in such a manner that the two pinching block plates overlap each other with the sheet body interposed therebetween; and the stretch function-added loading sheet has a stretch function in which the sheet body extends as the pinching jig opens by means of an opening/closing mechanism that the pinching jig has, which is caused by an application of a tensile force in a direction perpendicular to the folding centerline to the sheet body, while the sheet body contracts as the pinching jig closes by means of the opening/closing mechanism that the pinching jig has when the tensile force is reduced.

It is preferable that the stretch function-added loading sheet is provided with the plurality of forced crimping units.

The "pinching jig" is a device, such as a clip, etc., capable of sandwiching the two overlapping pinching block plates and maintaining this state. The wording "pinching jig opens" means that the interspace is widened between the portions where the targets (the two pinching block plates) are sandwiched. For example, in a hooked clip described below, this means that the interspace (clip opening width) is widened between a pair of opposing clip side walls. The wording "pinching jig closes" means that the interspace is narrowed between the portions where the targets (the two pinching block plates) are sandwiched from the state where the pinching jig opens. For example, in the hooked clip described below, this means that the interspace (clip opening width) is narrowed between the pair of opposing clip side walls from the state where the hooked clip opens.

The stretch function-added loading sheet is preferably configured such that:

the two pinching block plates have the same shape;

each of the pinching block plates is a rectangular plate having a block thickness, and a clip-fixing notch is provided in one surface of this plate in such a manner that the center of a notch length is aligned with the position of a longitudinal centerline of the block plate;

the pinching jig is a hooked clip;

the hooked clip has a structure formed by bending one rectangular metal plate and including a clip upper wall and a pair of opposing clip side walls connected to both ends of the clip upper wall, and the hooked clip is configured to be in a closed state where distal ends of the pair of opposing clip side walls come close to each other, and a state where the pair of opposing clip side walls are opened due to elastic deformation of metal when a clip-opening force is applied in a direction to the outside of each of the pair of opposing clip side walls, which constitutes the opening/closing mechanism;

fixing hooks each bent inward at a right angle are formed each at each distal end of the pair of clip side walls;

the two pinching block plates are situated symmetrically with respect to the folding centerline in a state where surfaces opposite to the surfaces in which the clip-fixing notches are provided face the sheet body;

the sheet body is folded along the folding centerline in such a manner that the two pinching block plates overlap each other with the sheet body interposed therebetween, and the fixing hooks of the hooked clip are fitted in the clip-fixing notches of the pinching block plates in a state where the hooked clip in an opened state so as to sandwich the two pinching block plates is attached; and the stretch function-added loading sheet is secured by any method and used such that an object to be loaded is placed on the sheet body.

The stretch function-added loading sheet is preferably configured such that:

the two pinching block plates have the same shape;

each of the pinching block plates is a rectangular plate having a block thickness, and a clip-fixing notch is provided in one surface of this plate in such a manner that the center of a notch length is aligned with the position of the longitudinal centerline of the block plate;

the pinching jig is a stopper-attached hooked clip;

the stopper-attached hooked clip includes one clip stopper, one perforated hooked clip, two screws, and two nuts;

the clip stopper has a structure including a stopper upper wall in which two screw-insertion holes are provided, and a pair of opposing stopper side walls that are fixed at both ends of the stopper upper wall;

the perforated hooked clip has a structure formed by bending one rectangular metal plate and including a clip upper wall and a pair of opposing clip side walls connected to both ends of the clip upper wall, and the perforated hooked clip is configured to be in a closed state where distal ends of the pair of opposing clip side walls come close to each other, and a state where the pair of opposing clip side walls are opened due to elastic deformation of metal when a clip-opening force is applied in a direction to the outside of each of the pair of opposing clip side walls, which constitutes the opening/closing mechanism;

fixing hooks each bent inward at a right angle are formed each at each distal end of the pair of clip side walls;

the clip upper wall is provided with two screw-insertion holes;

the stopper-attached hooked clip has a structure in which the clip stopper is placed over the perforated hooked clip, and in a state where the two screw-insertion holes of the perforated hooked clip are matched with the two screw-insertion holes of the clip stopper, the screws are passed through the screw-insertion holes, respectively, and fixed with the nuts;

the two pinching block plates are situated symmetrically with respect to the folding centerline in a state where surfaces opposite to the surfaces in which the clip-fixing notches are provided face the sheet body;

the sheet body is folded along the folding centerline in such a manner that the two pinching block plates overlap each other with the sheet body interposed therebetween, and the fixing hooks of the stopper-attached hooked clip are fitted in the clip-fixing notches of the pinching block plates in a state where the stopper-attached hooked clip in an opened state so as to sandwich the two pinching block plates is attached; and the stretch function-added loading sheet is secured by any method and used such that an object to be loaded is placed on the sheet body.

The stretch function-added loading sheet preferably:

further comprises a stopper hand, which is a flexible sheet, placed on a surface of the sheet body opposite to the surface in which the forced crimping unit is placed, wherein:

both end portions of the stopper band are tightly fixed to the sheet body on both sides of the folding centerline, respectively; and the stopper band is placed such that the portion between both end portions of the stopper band is curved or bent in a state where the tensile force is not applied to the sheet body, and the portion between both end portions of the stopper hand is flat-shaped in a state where the tensile force of a predetermined magnitude or greater is applied.

It is preferable that the stretch function-added loading sheet comprises a control component (control mechanism) that controls the maximum opening width of the pinching jig of the forced crimping unit. The control component (control mechanism) may include the clip stopper, the stopper band, etc.

The stretch function-added loading sheet preferably:

further comprises two fixing parallel frames, wherein:

the number of forced crimping units is even;

the sheet body has a rectangular shape, and two common folding centerlines that are parallel and symmetrical with respect to the sheet width centerline of the sheet body are located;

a half of the forced crimping units are attached in one row at equal intervals in such a manner that one of the common folding centerlines overlaps the folding centerline of each of the forced crimping units;

the remaining half of the forced crimping units are attached in one row at equal intervals in such a manner that the other of the common folding centerlines overlaps the folding centerline of each of the forced crimping units;

the half of the forced crimping units and the other half of the forced crimping units are symmetrically situated with respect to the sheet width centerline;

the two fixing parallel frames are attached to both end portions each located between each end edge of the sheet body in the sheet width direction and each of the rows of the forced crimping units, so as to be parallel to the sheet width centerline;

the two fixing parallel frames are fixed to any locations by any method; and the stretch function-added loading sheet is used such that an object to be loaded is placed between the two rows of the forced crimping units.

In each of the two rows of the forced crimping units of the stretch function-added loading sheet, it is preferable that a plurality of forced crimping units is attached. The lower limit of the number of the forced crimping units attached in one row is preferably three, and more preferably five. The upper limit of this number may be, for example, a hundred or twenty.

The stretch function-added loading sheet is preferably configured such that:

the sheet body is a fabric made of cotton;

the pinching block plates are made of wood; and the sheet body and the pinching block plates are fixed by an adhesive containing ethylene-vinyl acetate copolymer resin.

The other aspect of the present invention made for solving the above-mentioned problem is:

a chair comprising the stretch function-added loading sheet according to one aspect of the present invention, as at least one of a seating surface and a backrest.

Effect of the Invention

According to the present invention, it is possible to provide a stretch function-added loading sheet that has elasticity regardless of the material of the sheet body itself, and a chair comprising such a stretch function-added loading sheet,

EMBODIMENTS FOR CARRYING OUT THE INVENTION

The following is a detailed description of embodiment pertaining to a stretch function-added loading sheet and a chair with reference to the drawings as appropriate.

A First Embodiment

In a stretch function-added loading sheet of a first embodiment of the present invention, a device for imparting a stretch function to a sheet (sheet body (1)) is referred to as a forced crimping unit (2). First, the structure, etc. of the forced crimping unit (2) will be described below.

Figure 1A:
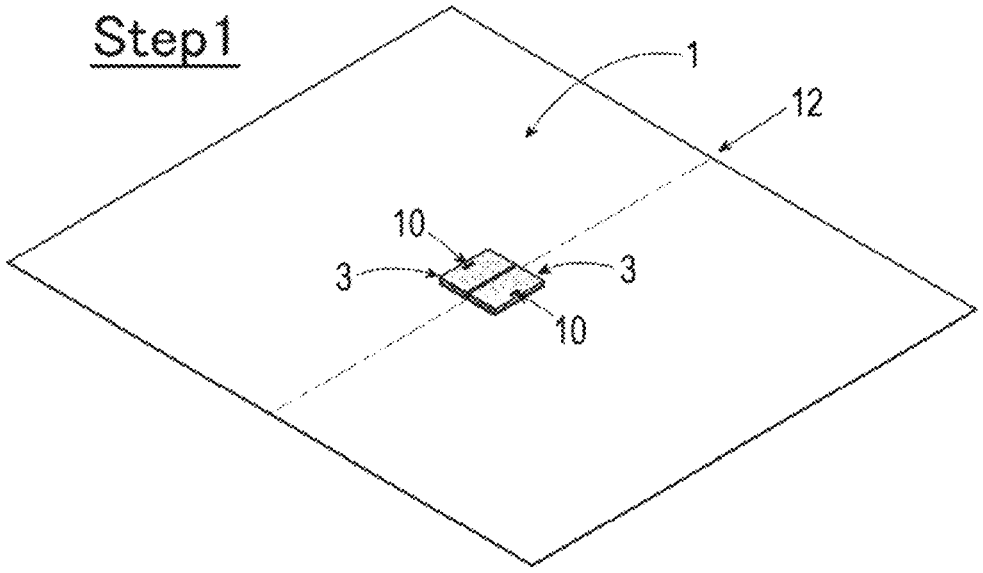
FIG. 1A is a first view showing procedure of assembling, one forced crimping unit included in a stretch function-added loading sheet of a first embodiment of the present invention.

FIG. 1A to FIG. 1D illustrates procedure of assembling one forced crimping unit (2). In FIG. 1A (Step 1), two pinching, block plates (3) are fixed on one surface of one sheet body (1) that is planarly unfolded. The two pinching block plates (3) have the same shape.

The sheet body (1) is a thin and broad thing having a light weight and flexibility, the material of which may include cloth made of natural or chemical fibers, a polymeric resin sheet (plastic sheet), paper, as well as one containing a metal material, etc. The sheet body (1) is intended for loading, and thus a load-bearing capacity is required that is capable of withstanding the load of an object placed on the sheet that is fixed to a frame or suspension fulcrums and unfolded. In other words, the sheet body (1) may be a load-bearing sheet. The tensile strength of the sheet body (1) may be, for example, 1 N/50 mm or greater, may be 10 N/50 mm or greater, or may be 100 N/50 mm or greater. The tensile strength of the sheet body (1) may be, for example, 10 kN/50 mm or smaller, or may be 4 kN/50 mm or smaller. The tensile strength of the sheet body (1) may be of a value measured by the strip method as specified in the JIS L1096. As the unfolded shape of the sheet body (1), an example of a rectangular shape is shown in FIG. 1A, etc., but this can be any shape.

Figure 2A:
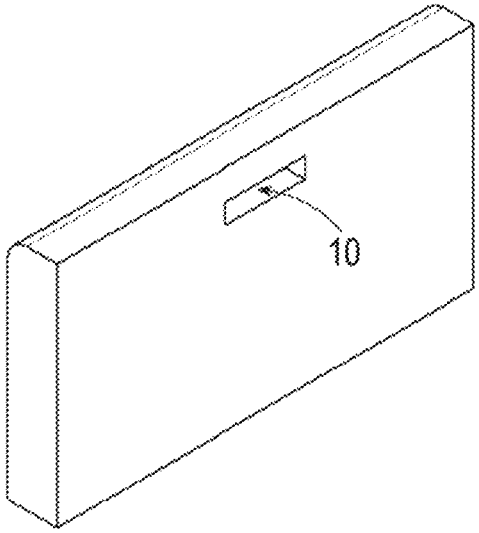
FIG. 2A is a perspective view of a pinching block plate used for the stretch function-added loading sheet of the first embodiment.
Figure 2B:
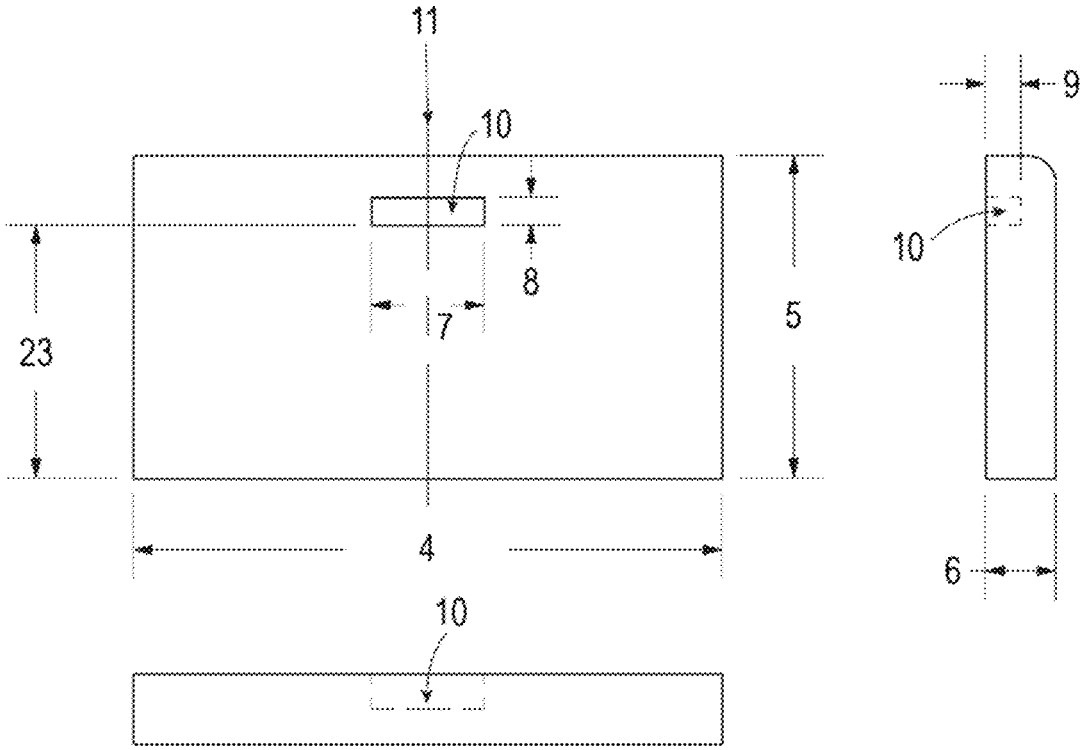
FIG. 2B is a three-plane drawing of the pinching block plate of FIG. 2A.

As shown in FIGS. 2A and 2B, the pinching block plate (3) is a rectangular plate having a size of a block length (4) by a block height (5) and having a block thickness (6), and sufficient rigidity is obtained by increasing the block thickness (6). The material of the pinching block plate (3) includes wood, plastic, metal, etc. A clip-fixing notch (10) having a size of a notch length (7) by a notch width (8) by a notch depth (9) is provided in one surface of the pinching block plate (3), which is placed in such a manner that the center of the notch length (7) is aligned with the position of the block plate longitudinal centerline (11). The clip-fixing notch (10) is provided near one end in the block height (5) direction (near the upper end in the perspective view of FIG. 2A).

In FIG. 1A (Step 1), surfaces of the two pinching block plates (3), which are opposite to the surfaces in which the clip-fixing notches (10) are provided, are made to face the sheet body (1), and the two pinching block plates (3) are situated in a symmetrical and parallel manner with respect to a folding centerline (12) on the sheet body (1) with the clip-fixing notches (10) being located on outer sides. The entire contact surfaces of the pinching block plates (3) and the sheet body (1) are tightly attached and fixed. The method of tightly fixing includes, a method using an adhesive and a method of forming the sheet body (1) integrally with the pinching block plates (3) made of a plastic material, etc., and so on.

Figure 1B:
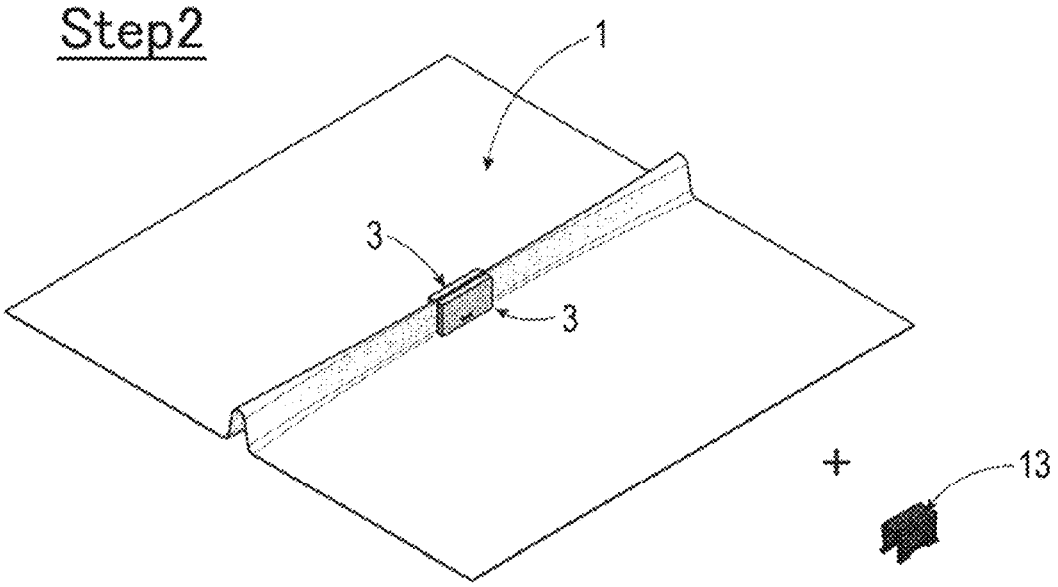
FIG. 1B is a second view showing procedure of assembling the one forced crimping unit included in the stretch function-added loading sheet of the first embodiment of the present invention.

FIG. 1B (Step 2) illustrates the state that is changed from the state shown in FIG. 1A (Step 1) to the state in which the sheet body (1) is folded along the folding centerline (12) in such a manner that the two pinching block plates (3) overlap each other with the sheet body (1) interposed therebetween. When doing so, the portions of the sheet body (1) that are tightly fixed to the two pinching block plates (3) are also overlapped each other. The bending angle of the crimped portion that is formed by folding the sheet body (1) varies so that the stretch function of the sheet body (1) is achieved. In addition, a hooked clip (13) that is an example of a pinching jig used in FIG. 1C (Step 3) is also shown.

Figure 1C:
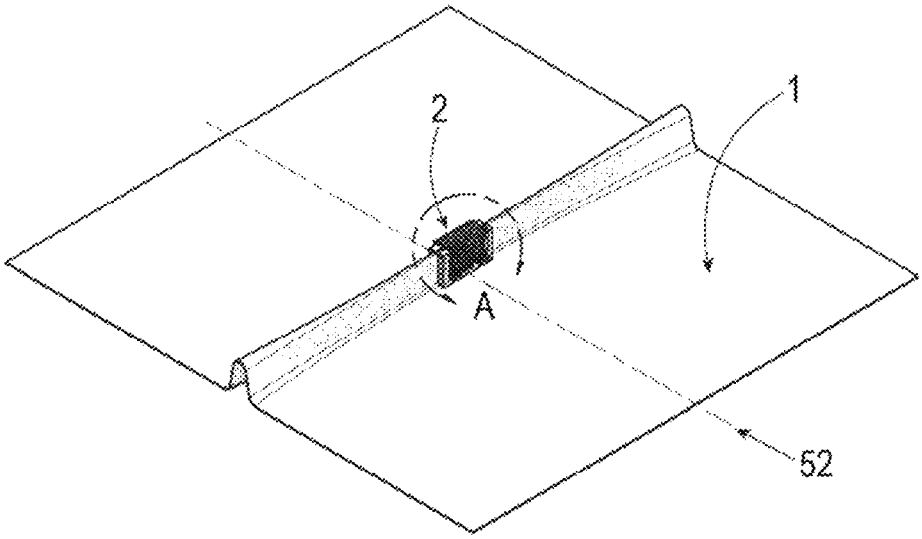
FIG. 1C is a third view showing procedure of assembling the one forced crimping unit included in the stretch function-added loading sheet of the first embodiment of the present invention.
Figure 1D:
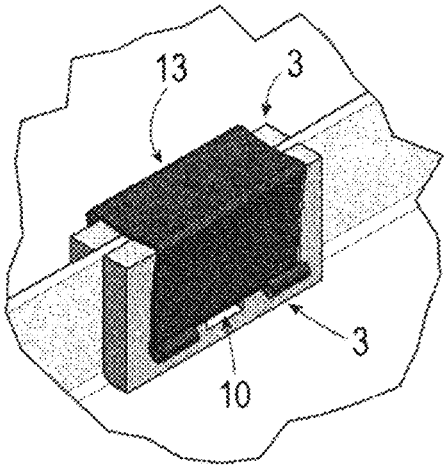
FIG. 1D is an enlarged view of the forced crimping unit of FIG. 1C.

FIG. 1C (Step 3) illustrates the state in which the hooked clip (13) is set to the two pinching block plates (3) in the state of FIG. 1B (Step 2), and one forced crimping unit (2) is thereby completed.

Figure 3A:
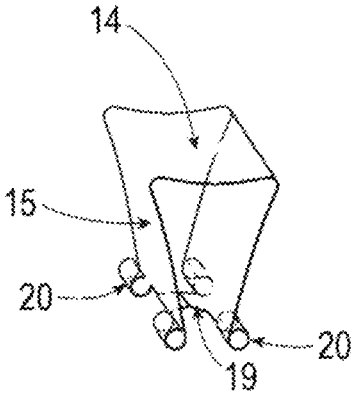
FIG. 3A is a perspective view showing a hooked clip in a closed state used for the stretch function-added loading sheet of the first embodiment.
Figure 3B:
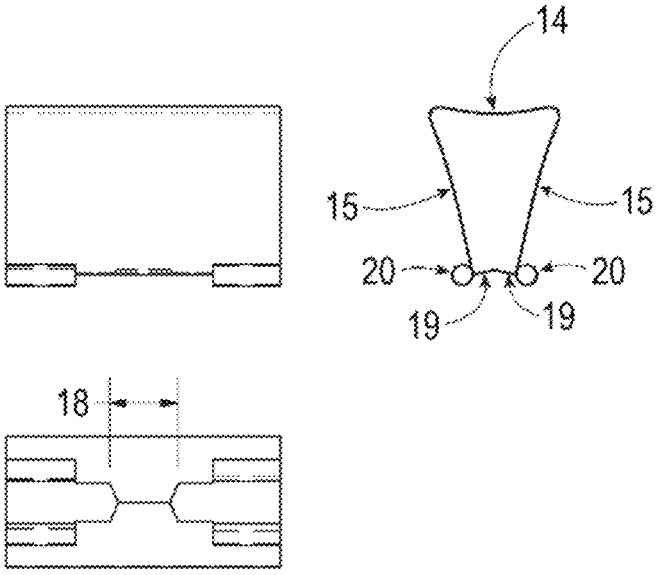
FIG. 3B is a three-plane drawing of the hooked clip in the state shown in FIG. 3A.
Figure 3C:
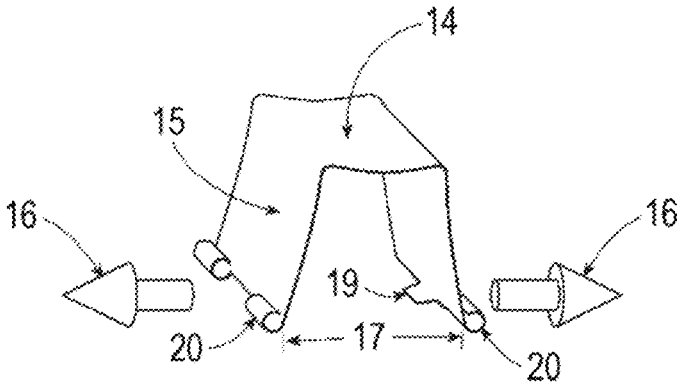
FIG. 3C is a perspective view showing the hooked clip in an opened state used for the stretch function-added loading sheet of the first embodiment.
Figure 3D:
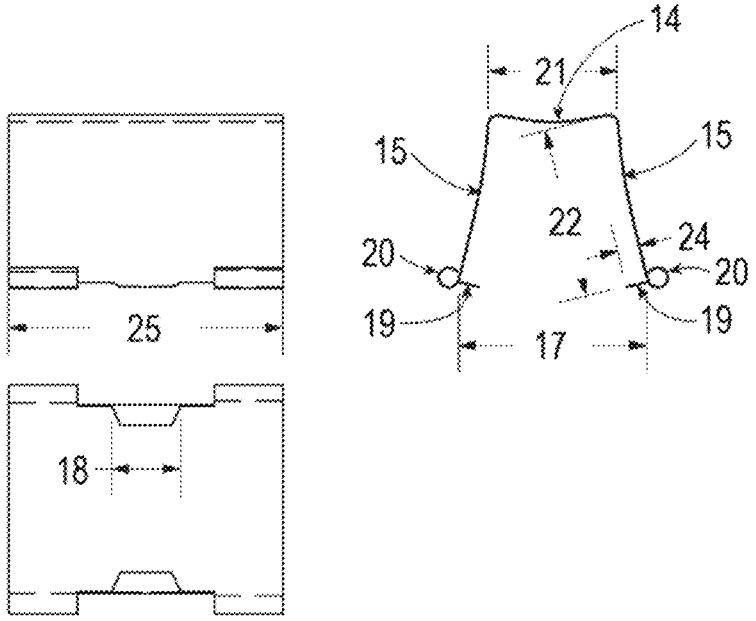
FIG. 3D is a three-plane drawing of the hooked clip in the state shown in FIG. 3C.

FIGS. 3A to 3D illustrate the structure and operation of the hooked clip (13) made of metal. The hooked clip (13) has the same form and works according to the same operational principle as typical clips made of metal and used for binding documents, etc. As illustrated in FIGS. 3A and 3B, the hooked clip (13) is formed by bending one rectangular metal plate to have a structure including a clip upper wall (14) and a pair of opposing symmetrical clip side walls (15) connected to both ends of the clip upper wall (14). In the hooked clip (13), the clip upper wall (14) and each of the clip side walls (15) form an acute angle therebetween, so that the distal ends of the pair of opposing clip side walls (15) are close to or in contact with each other. When no force is applied as such, the clip is in a closed state as shown in FIGS. 3A and 3B. Meanwhile, as shown in FIGS. 3C and 3D, the pair of opposing clip side walls (15) can be opened by an application of a clip-opening force (16) to each of the pair of clip side walls (15) in an outward direction. This is caused by elastic deformation of metal, and thus a clip-opening width (17) is increased as the clip-opening force (16) is increased, and the state returns to the closed state shown in FIGS. 3A and 3B again when the clip-opening force (16) is made zero. The relation between the clip-opening width (17) and the clip-opening force (16), which indicates elasticity, is determined by the elastic modulus of the metal material, the thickness, width, and bending shape, etc. of the metal plate of the hooked clip (13) and is designed to be optimal in use for loading after completion. Typical clips for binding documents, etc. accepts a possibility of slippage of a clip attached to documents. In contrast, for having the hooked clips (13) fixed without being slipped, fixing hooks (19) each bent inward at a right angle by a fixing hook width (18) in a distal end center portion are formed at the distal ends of the pair of clip side walls (15).

As typical clips, jig-insertion tubes (20), which are formed by bending the distal ends of the clip side walls (15) outward into a circular shape, are attached to both sides of each of the fixing hooks (19). This is for fitting jigs into the jig insertion tubes (20) so as to open/close the clip from the outside and used for convenience during the assembly of the forced crimping unit (2), and thus this is not normally used when the stretch function-added loading sheet is in use for loading after the completion. In FIGS. 1C (Step 3) and 1D, the hooked clip (13) in an opened state of FIGS. 3C and 3D is attached so as to sandwich the two overlaid pinching block plates (3), and the fixing hooks (19) are fitted in the clip-fixing notches (10) and fixed therein.

Here, the internal clip width dimension (21) is equal to or greater than the total of the double of the block thickness (6) and the double of the thickness of the sheet body (1); the internal clip height dimension (22) is equal to or greater than the notch height (23) of the pinching block plate (3); the fixing hook width (18) is equal to or smaller than the notch length (7); and the fixing hook length (24) is equal to or smaller than the notch depth (9).

When no force is applied from the outside, a force in the closing direction is applied to the opened hooked clip (13) so that the opposing two pinching block plates (3) are forcibly closed (FIG. 1C (Step 3)). The hooked clip (13) is opened by an application of an external tensile force to portions of the sheet body (1) located in the left and right perpendicular direction with respect to the folding centerline (12) with respect to the forced crimping unit (2). The opening/closing of the hooked clip (13) caused by elastic deformation directly constitutes a change in the bending angle of the sheet body (1) in the crimped portion, and the stretch function with elasticity is thereby achieved.

Any number of the forced crimping units (2) are placed in any positions on one sheet body (1) in any shape, and the stretch function-added loading sheet pertaining to the first embodiment of the present invention is thus completed. The stretch function-added loading sheet is fixed to each of various loading devices by any method, and used such that an object to be loaded is placed on the sheet body (1).

Figure 4A:
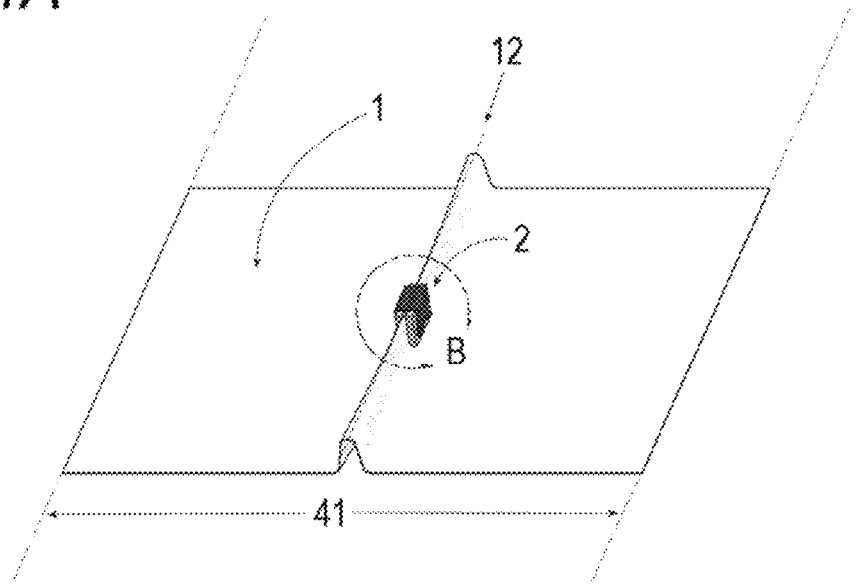
FIG. 4A is a perspective view of the stretch function-added loading sheet of the first embodiment of the present invention.
Figure 4B:
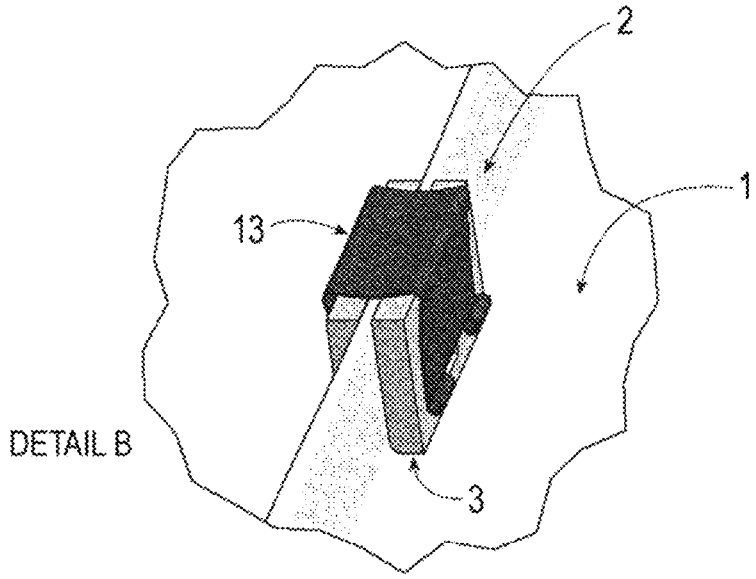
FIG. 4B is an enlarged view of the forced crimping unit included in the stretch function-added loading sheet of FIG. 4A.
Figure 4C:
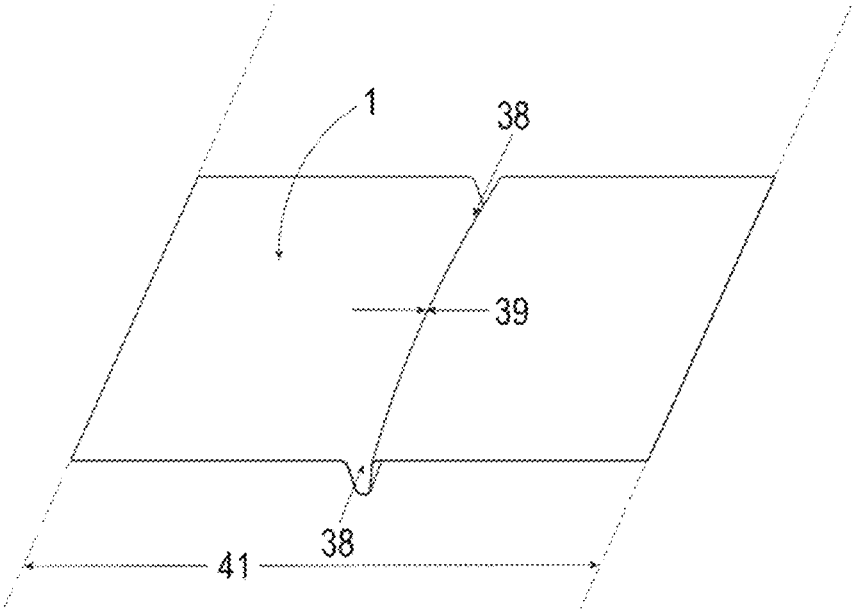
FIG. 4C is a view showing a turned-over state of the stretch function-added loading sheet of FIG. 4A.
Figure 4D:
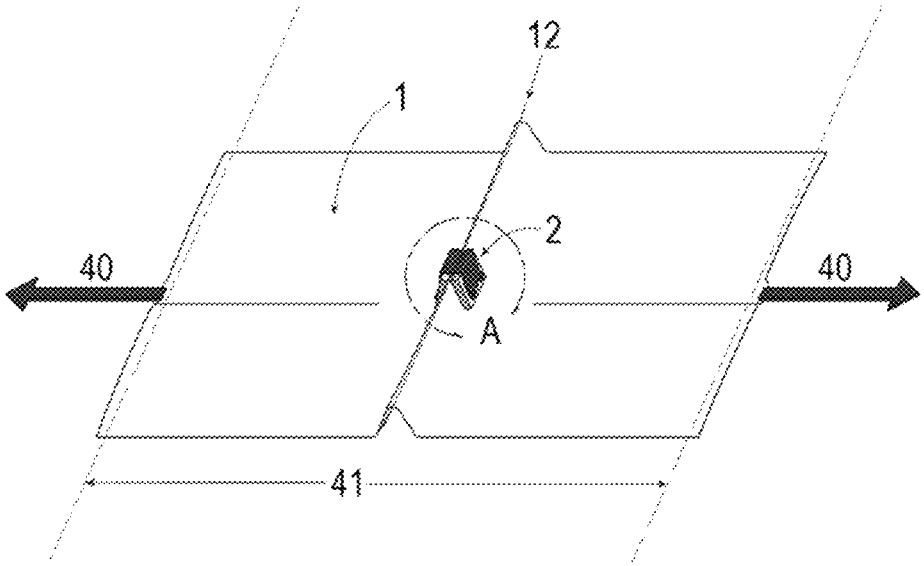
FIG. 4D is a perspective view showing a state in which a tensile force is applied to the stretch function-added loading sheet of FIG. 4A.
Figure 4E:
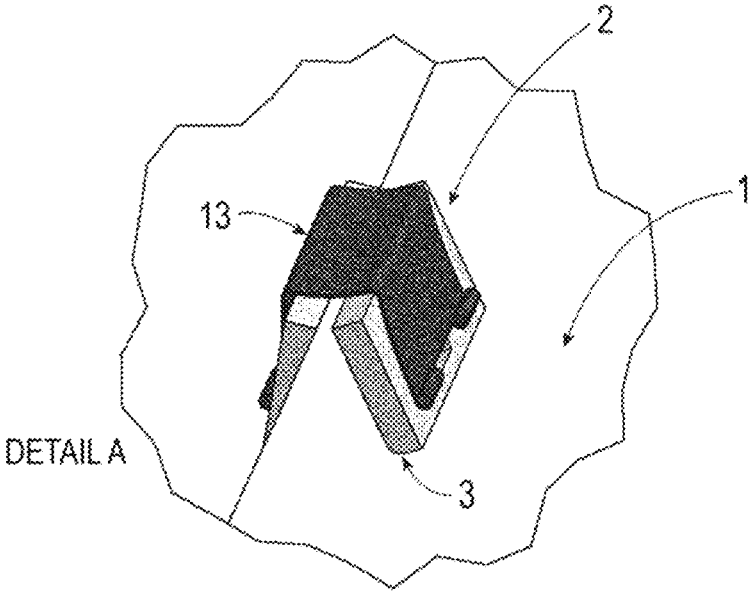
FIG. 4E is an enlarged view of the forced crimping unit included in the stretch function-added loading sheet in the state shown in FIG. 4D.
Figure 4F:
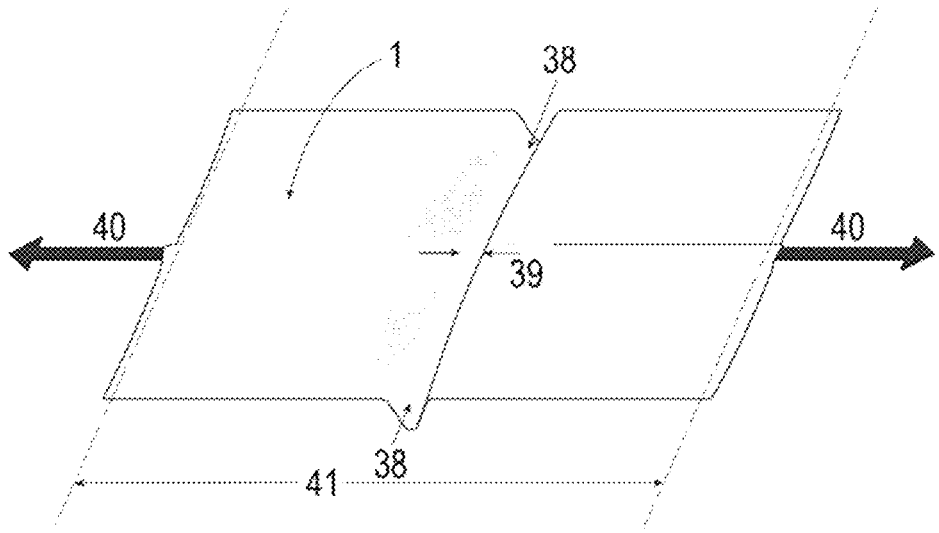
FIG. 4F shows a turned-over state of the stretch function-added loading sheet in the state shown in FIG. 4D.

FIGS. 4A to 4F are explanatory views showing the operations of the stretch function-added loading sheet of the first embodiment. Regarding the sheet body (1) in which one completed forced crimping unit (2) in the same state as shown in FIG. 1C (Step 3) is placed. FIG. 4A shows the device side and FIG. 4C shows the back side, wherein no external force is applied. In FIG. 4C in which FIG. 1C (Step 3) is seen from the back side, the forced crimping unit (2) cannot be seen but only one crimp groove (38) can be seen. The crimp gap (39) represents the width of the crimp groove (38). Here, the clip-opening width (17) of the hooked clip (13) is identical with the thickness of the two pinching block plates (3) (block thickness (6)×2) and the two sheet bodies (1), wherein, because of the operational principle described above, no external force is applied, and thus a force compressing the two pinching block plates (3) is applied correspondingly, so that the portions of the sheet body (1) tightly fixed to the overlaid pinching block plates (3) are also compressed and the crimp gap (39) is thereby eliminated. FIGS. 4D to 4F illustrate the state changed from the state shown in FIGS. 4A to 4C to a state in which a tensile force (40) in the perpendicular direction with respect to the folding centerline (12) is applied to portions of the sheet body (1) located in the left and right perpendicular direction with respect to the folding centerline (12) of the forced crimping unit (2), wherein FIG. 4D is a schematic view of the device side, and FIG. 4F is a schematic view of the back side. This tensile force (40) is transmitted from the sheet body (1) to the pinching block plates (3) that are tightly fixed thereto, and this acts on the fixing hooks (19) of the hooked clip (13), which are fixed in the clip-fixing notches (10) of the pinching block plates (3). Accordingly, the tensile force (40) acts as a force applied to the same points and in the same direction as the clip-opening force (16) shown in FIG. 3C, and serves as a force for opening the hooked clip (13). Since the opening/closing of the hooked clip (13) is caused by elastic deformation, an application of the tensile force (40), which is equal to or greater than the force compressing the two pinching block plates (3) in the state where the hooked clip (13) is opened as shown in FIGS. 4A to 4C, causes the clip-opening width (17) to increase from the state shown in FIGS. 4A to 4C, and a gap is thereby generated between the portions of the sheet body (1) that are tightly fixed to the two pinching block plates (3) (crimp gap (39)>0). When the tensile force (40) is further increased, the clip-opening width (17) is increased, and the crimp gap (39) is also increased. When the tensile force (40) is reduced again, the crimp gap (39) is also decreased. Naturally, the size of the crimp gap (39) is directly added to an initial sheet width (41) in a direction perpendicular to the folding centerline, and thus the stretch function with elasticity of the sheet body (1) is achieved. Furthermore, this forced crimping unit (2) is intended for forcibly generating a crimp (wrinkle) in any position in the sheet body (1), and thus the forced crimping unit (2) can be used as a novel element for controlling the shape of a sheet other than the elements such as the frame or suspension fulcrums for securing the sheet as well as an object to be loaded, and designing for improving shape conformability is enabled.

As the sheet body (1) is required to have flexibility, the sheet body (1) is thin and lightweight, and is likely to be torn when a force is locally applied. Therefore, as shown in FIGS. 4D to 4F, when the tensile force (40) that serves as the clip-opening force (16) of the hooked clip (13) is applied via the sheet body (1), the sheet body (1) at the contact points between the hooked clip (13) and the sheet body (1) may be easily damaged if these contact points are small. Accordingly, the pinching block plates (3), which are thicker than the sheet body (1) and have rigidity and are less susceptible to damage, are placed between the hooked clip (13) and the sheet body (1), and the contact surfaces of the pinching block plates (3) and the sheet body (1) are made to have large areas and tightly fixed to each other, and the tensile force (40) is thereby distributed by the area of the contact surfaces and it is possible to suppress the damage to the sheet body (1) as well.

A Second Embodiment

Figure 5A:
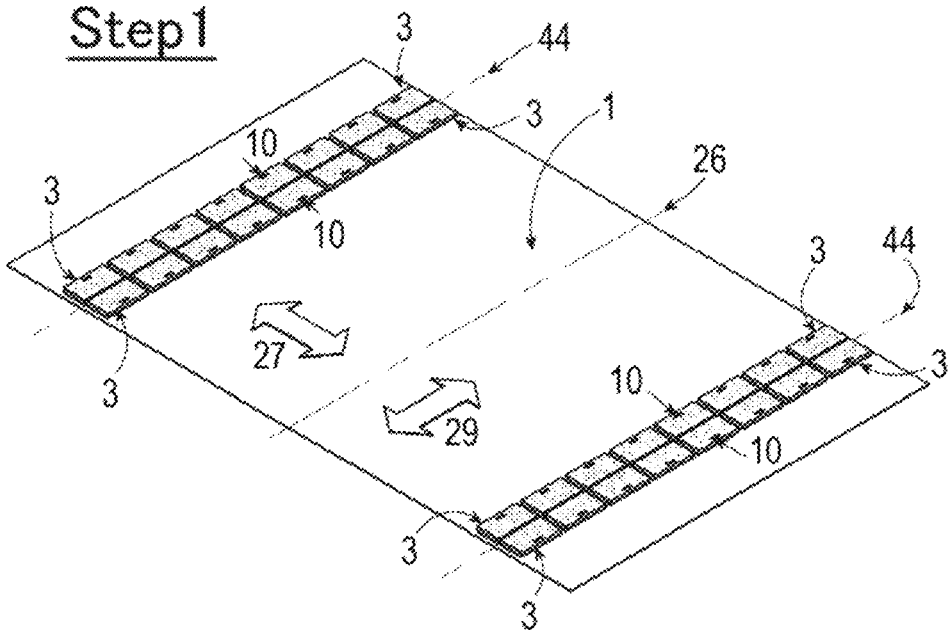
FIG. 5A is a first view showing procedure of assembling a stretch function-added loading sheet of a second embodiment of the present invention.

As an example of placing the forced crimping units (2) on the sheet body (1), a stretch function-added loading sheet will be described, which is implemented with the placement in two parallel rows at both ends which constitutes a simple structure and can be applied to various loading devices. FIGS. 5A to 5D illustrate procedure of assembling the stretch function-added loading sheet as the second embodiment. The steps shown in FIG. 5A (Step 1), FIG. 5B (Step 2) and FIG. 5C (Step 3) correspond to the procedure shown in FIG. 1A (Step 1), FIG. 1B (Step 2) and FIG. 1C (Step 3), respectively. FIG. 5A (Step 1) illustrates the procedure of placing and fixing the pinching block plates (3) on the sheet body (1). The sheet body (1) has a rectangular shape, and two common folding centerlines (44) are located, which are parallel and symmetrical with respect to the sheet width centerline (26). After completion, an object to be loaded is placed between the two common folding centerlines (44), and thus the spacing between the two common folding centerlines (44) is designed accordingly. Each of fixing parallel frames (28) shown in FIG. 5D (Step 4) is placed between each of the common folding centerlines (44) and each of edges of the sheet body (1) in the sheet width direction (27) located on outer sides of the common folding centerlines (44), and thus the spacing therebetween is designed accordingly. As FIG. 1A (Step 1), the two pinching block plates (3), which are used for forming one forced crimping unit (2), are situated in a symmetrical and parallel manner with respect to the common folding centerline (44) with the clip-fixing notches (10) being located on outer sides. Here, in the placement of the present embodiment, in order to place a plurality of forced crimping units (2) at equal intervals on the two common folding centerlines (44), a plurality of combinations of two pinching block plates (3) are placed at equal intervals on the common folding centerlines (44). That is, the folding centerline (12) (see FIG. 1A, etc.) of each of the forced crimping units (2) overlaps either of the two common folding centerlines (44). The relationship of placement of the pinching block plates (3) on the two common folding centerlines (44) on the left and right is such that the pinching block plates (3) are situated so as to be symmetrical with respect to the sheet width centerline (26) so that the locations, quantities, and spacings in the sheet length direction (29) are all identical, and the entire contact surfaces of all of the pinching block plates (3) and the sheet body (1) are tightly fixed. In FIG. 5A (Step 1), eight forced crimping units (2), that is, eight sets of two pinching block plates (3) are placed on one common folding centerline (44), which indicates that a total of sixteen forced crimping units (2) are being assembled.

Figure 5B:
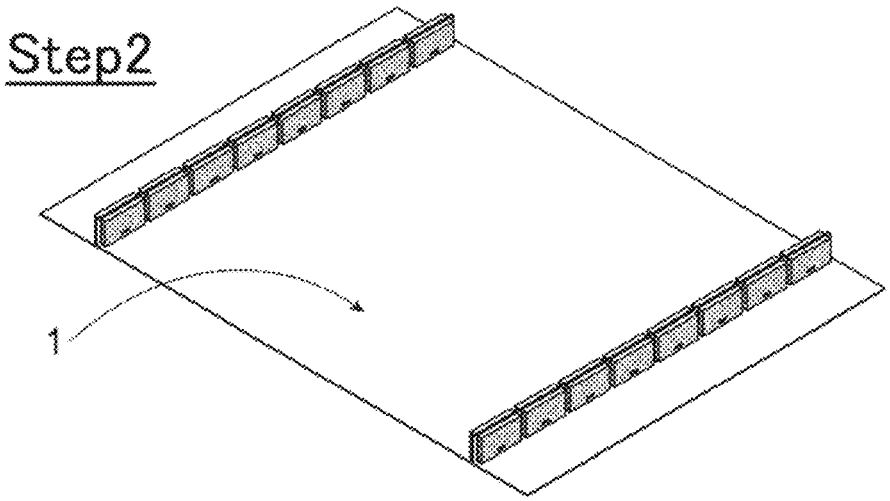
FIG. 5B is a second view showing procedure of assembling the stretch function-added loading sheet of the second embodiment of the present invention.

FIG. 5B (Step 2) illustrates the procedure of having the two pinching block plates (3) constituting each of the forced crimping units (2) overlaid with each other with the sheet body (1) interposed therebetween from the state shown in FIG. 5A (Step 1), and this procedure is completed by making folds along the two entire common folding centerlines (44).

Figure 5C:
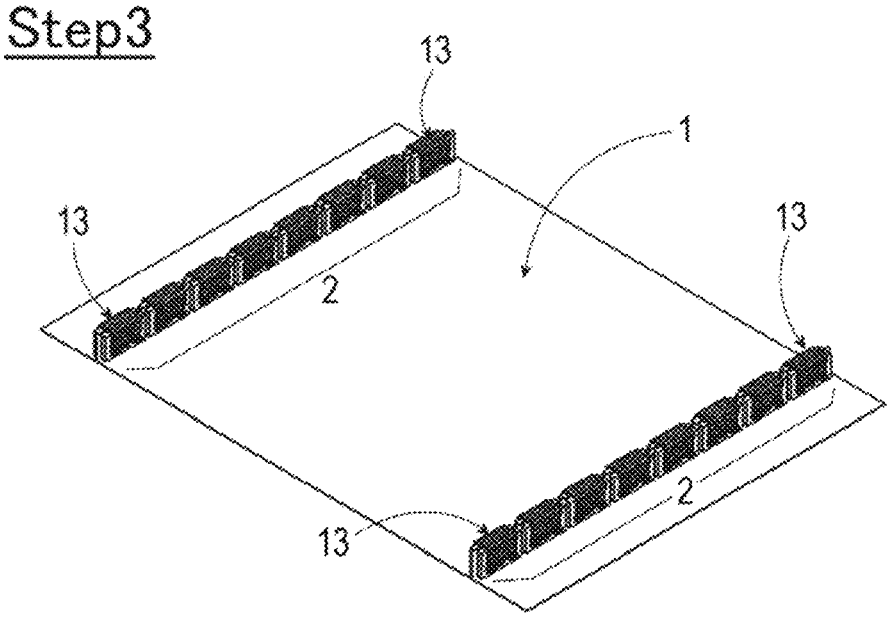
FIG. 5C is a third view showing procedure of assembling the stretch function-added loading sheet of the second embodiment of the present invention.

FIG. 5C (Step 3) illustrates the state in which each one of the hooked clips (13) is set to each of all of the two overlaid pinching block plates (3) in the state shown in FIG. 5B (Step 2), and the forced crimping units (2) are thereby completed. FIG. 5C (Step 3) illustrates that a total of sixteen forced crimping units (2) are completed.

As thus described, in the present embodiment, the number of forced crimping units (2) is even, and a half of the forced crimping units (2) are attached in one row at equal intervals in such a manner that one of the common folding centerlines (44) coincides with the folding centerline of each of the forced crimping units (2). Also, the remaining half of the forced crimping units (2) are attached in one row at equal intervals in such a manner that the other of the common folding centerlines (44) coincides with the folding centerline of each of the forced crimping units (2). The half of the forced crimping units (2) and the remaining half of the forced crimping units (2) are situated to the symmetrical with respect to the sheet width centerline (26).

Figure 5D:
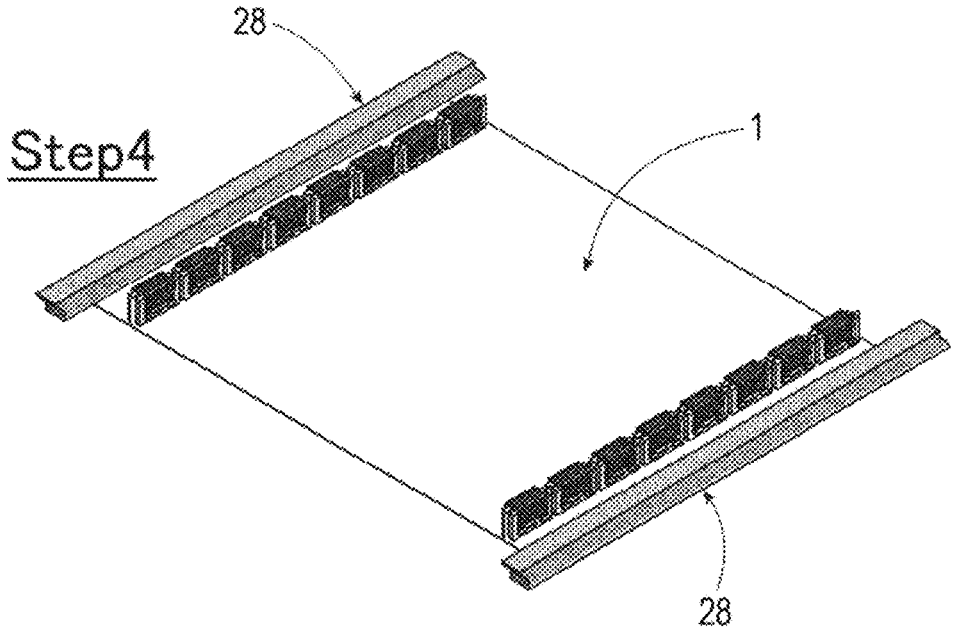
FIG. 5D is a fourth view showing procedure of assembling the stretch function-added loading sheet of the second embodiment of the present invention.

FIG. 5D (Step 4) illustrates the state in which the sheet body (1) on which the forced crimping units (2) of FIG. 5C (Step 3) are placed is attached to the two fixing parallel frames (28), and the stretch function-added loading sheet of the present embodiment is thereby completed. The two fixing parallel frames (28) are attached to both end portions each located between each of the edges in the sheet width direction (27) of the sheet body (1) and each of the rows of the forced crimping units (2), so as to be parallel to the sheet width centerline (26), i.e., parallel to the sheet length direction (29). The two fixing parallel frames (28) attached are fixed in any location by any method so that their positional relation is fixed and stationary. When an object to be loaded is actually placed, the side on which the forced crimping units (2) are placed is a back surface of the sheet body (1) and oriented to face downward, and the object to be loaded is placed on the surface that is a front surface of the sheet body (1) on which the forced crimping units (2) are not placed. The object to be loaded is placed on the sheet body (1) in the location between the two rows of the forced crimping units (2). As the object to be loaded is placed on the sheet body (1) in the location between the two fixing parallel frames (28) and a load is thereby applied, a force is applied in an inward direction perpendicular to the fixing parallel frames (28). As described above, any method can be used for keeping the positional relation, such as a method of withstanding this force and securing the distance between the two fixing parallel frames (28). The relation between the width in the sheet width direction (27) of the sheet body (1) and the distance between the two fixing parallel frames (28) is designed in consideration of the elongation of the material itself when the sheet body (1) after completion is used for loading, and the target degree of sagging, etc. Specific methods for attaching the sheet body (1) to the fixing parallel frames (28) may be any methods and include: a method of forming sheet edge tubes (43) that continues from the sheet on the left and right edges in the sheet width direction (27) of the sheet body (1), and inserting the fixing parallel frames (28) therethrough; and a method of driving studs or staples through the sheet body (1) into wooden fixing parallel frames (451) (see a fifth embodiment and a sixth embodiment).

Figure 6A:
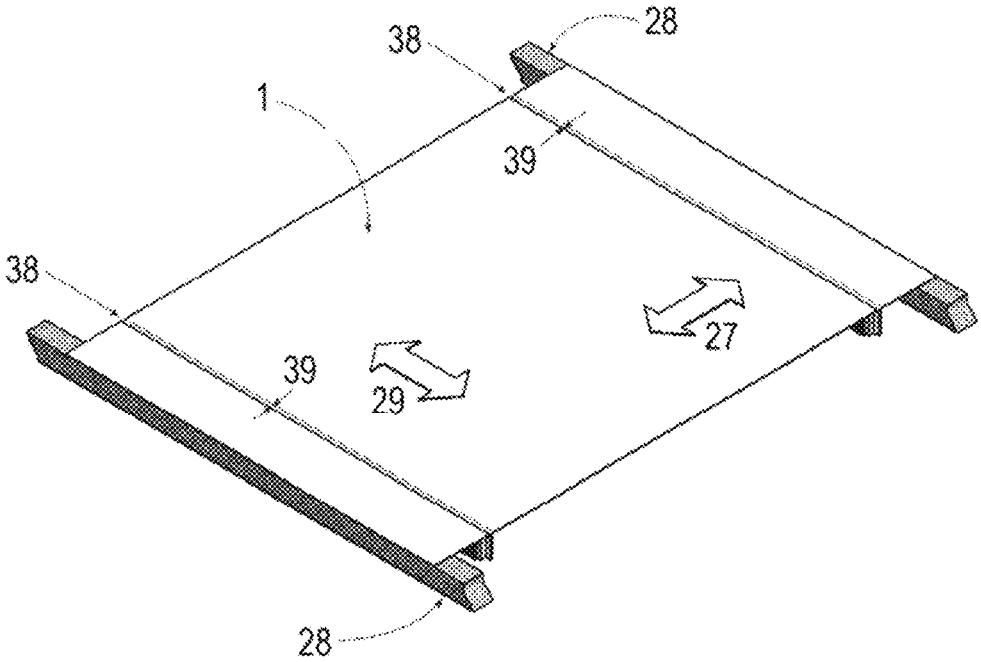
FIG. 6A is a perspective view of the stretch function-added loading sheet of the second embodiment of the present invention.
Figure 6B:
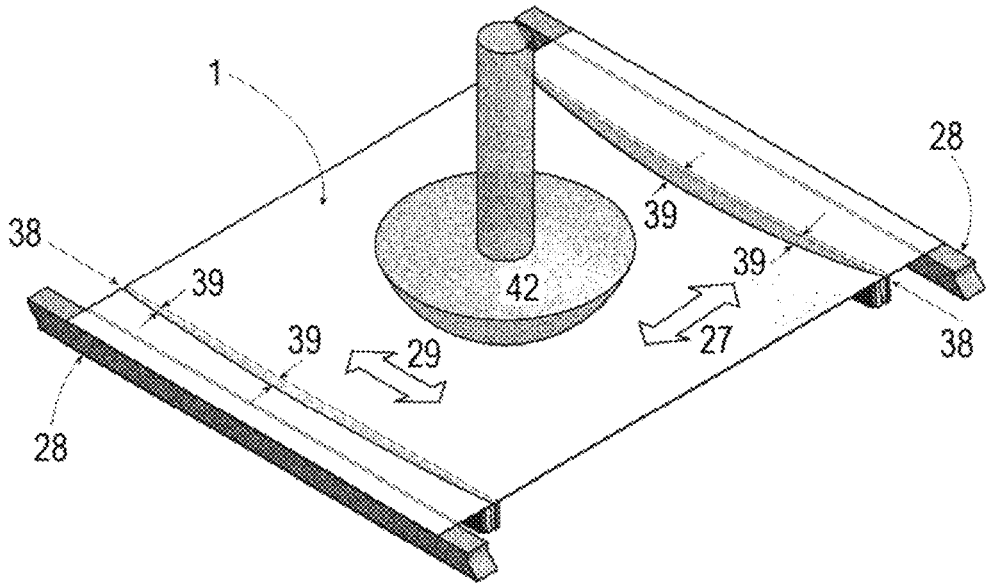
FIG. 6B is a perspective view showing a state in which an object to be loaded is placed in the center of the stretch function-added loading sheet in the state shown in FIG. 6A.
Figure 7A:
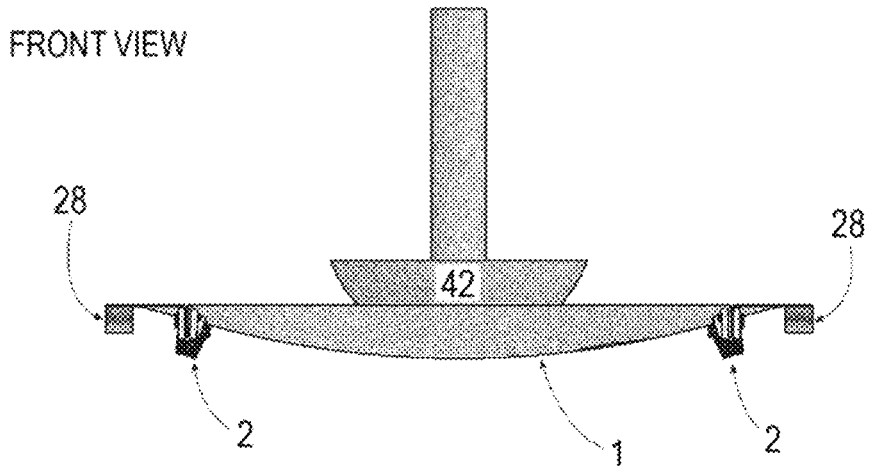
FIG. 7A is a front view of the state shown in FIG. 6B.
Figure 7B:
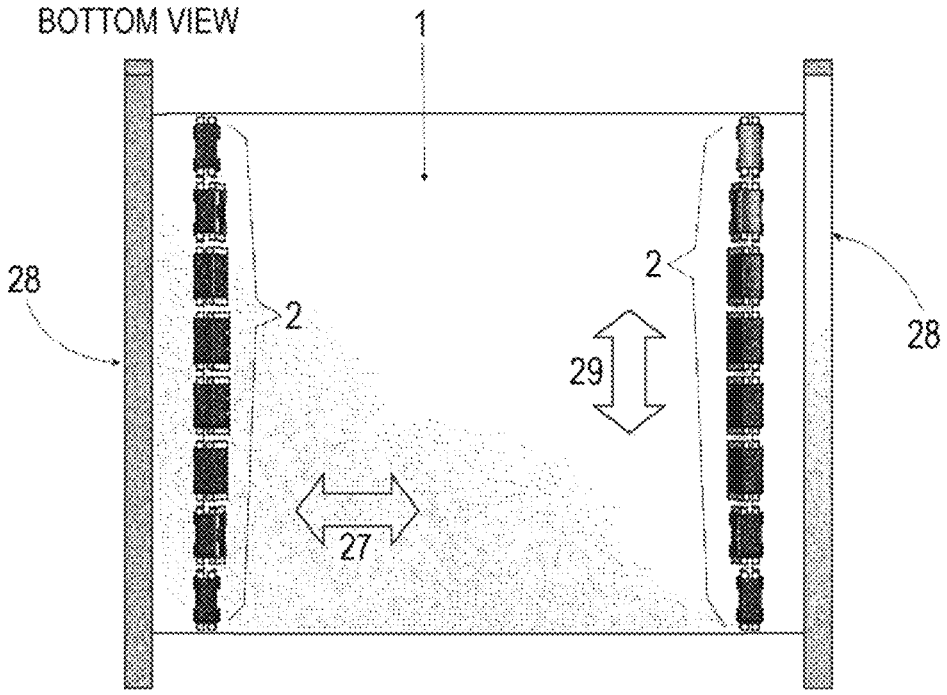
FIG. 7B is a bottom view of the state shown in FIG. 6B.
Figure 7C:
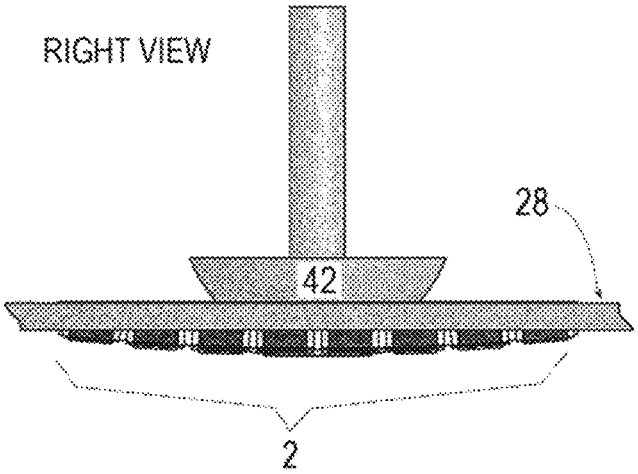
FIG. 7C is a right-side view of the state shown in FIG. 6B.

FIG. 6A is a view in which the completed stretch function-added loading sheet of the second embodiment of FIG. 5D (Step 4) is turned over to show the vertical positional relation in normal use, wherein the two rows of the forced crimping units (2), which are attached to both ends in the sheet width direction (27) to be parallel to the sheet length direction (29), are seen as the crimp grooves (38) when the sheet is turned over. At this time, the sheet body (1) is designed to be flat without any slack except the crimp grooves (38). FIG. 6B is a schematic view showing the deformation state of the sheet body (1) from the state of FIG. 6A when a spherical-object load (42) is placed in the center of the stretch function-added loading sheet of the second embodiment. FIG. 6A shows that the crimp gap (39) is zero regardless of the position in the sheet length direction (29), whereas FIG. 6B shows that the crimp gap (39) near the center where the spherical-object load (42) is placed is the largest, and the crimp gap (39) decreases as the distance from both ends in the sheet length direction (29) decreases. FIGS. 7A to 7C is a three-plane drawing (a front view, a bottom view, and a right-side view) showing the same state as the state shown in FIG. 6B. FIG. 7A illustrates a state in which the sheet body (1) has a shape in which a portion near the center is sagging, which indicates that the spherical-object load (42) placed near the center acts as the clip-opening force (16) of the hooked clips (13) of the forced crimping units (2) in the rows located on both sides, and widens the clip opening width (17), thereby increasing the width in the sheet width direction (27) of the sheet body (1). FIG. 7B illustrates that the clip-opening width (17) of each of the hooked clips (13) is the widest, which are components of the forced crimping units (2) on the left and right near the center in the sheet length direction (29) where the spherical-object load (42) is placed, while the clip opening width (17) decreases as the distance from both ends in the sheet length direction (29) decreases, which indicates that there occur differences in opening/closing of the hooked clips (13) according to the locations in the sheet length direction (29) conforming to the location in the sheet length direction (29) and shape of the loaded object. FIG. 7C illustrates a state in which the sheet body (1) has a shape in which a portion near the center is sagging, which indicates that the width in the sheet width direction (27) of the sheet body (1) in the location near the center in the sheet length direction (29) is most expanded because of the differences in opening/closing of the hooked clips (13) according to the locations in the sheet length direction (29) shown in FIG. 7B, while the width in the sheet width direction (27) of the sheet body (1) decreases as the distance from both ends in the sheet length direction (29) decreases. In this way, in the stretch function-added loading sheet of the second embodiment, there occur differences in opening/closing of the hooked clips (13) according to the locations in the sheet length direction (29), which results from the load depending on the location in the sheet length direction (29) and the shape of the loaded object, and there occur variation in the width in the sheet width direction (27) of the sheet body (1) conforming to the location in the sheet length direction (29) and the shape of the loaded object, so that the sheet body (1) has a shape conforming to the loaded object, and the contact surfaces of the loaded object and the sheet body (1) are thereby increased, and the load applied to the loaded object per unit contact area is decreased, and it is possible to improve the shape conformability which suppresses the slippage of the loaded object. In addition, the positional difference in the sheet width direction (27) provides a small difference in the effect yielded by the forced crimping units (2), and thus it is preferable that the location of the object to be loaded is in the center in the sheet width direction (27). Also, during the transitional period of deformation of the sheet body (1) caused by load variation, the shock applied to the loaded object is alleviated by the elasticity exerted by the opening/closing of the hooked clips (13).

A Third Embodiment

Figure 8A:
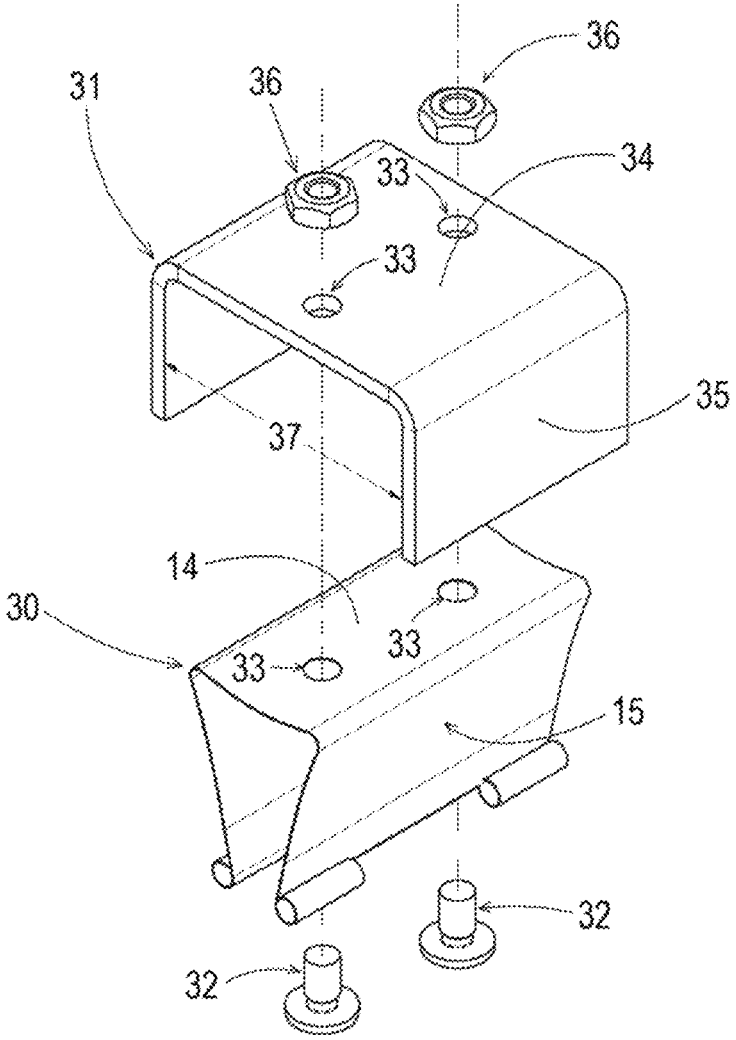
FIG. 8A is an assembly view of a stopper-attached hooked clip used for a stretch function-added loading sheet of a third embodiment of the present invention.
Figure 8B:
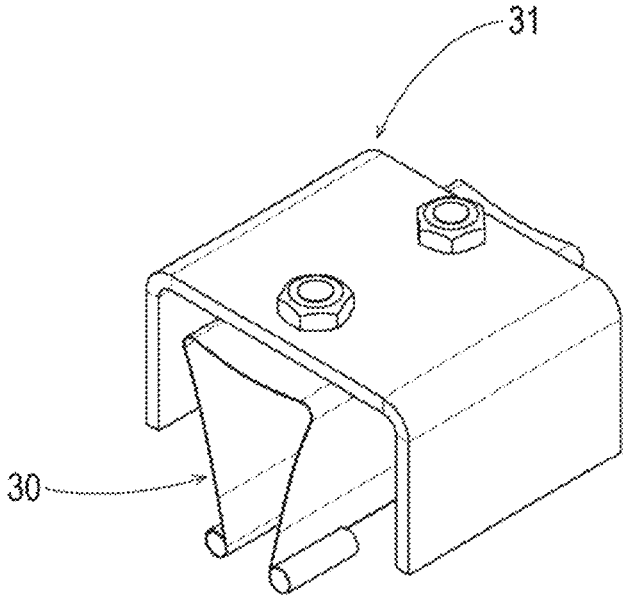
FIG. 8B is a perspective view of the stopper-attached hooked clip used for the stretch function-added loading sheet of the third embodiment of the present invention.

The elastic force exerted by the opening/closing of the hooked clip (13) used for the forced crimping unit (2) is determined by the type of metal, metal thickness, shape, etc. of the hooked clip (13), and is designed according to the type of the object to be regularly loaded and the elasticity required in use after completion of the loading sheet. However, if a load that is greater than a normal load is suddenly applied, the clip-opening width (17) of the hooked clip (13) may open too wide, which may cause the hooked clip (13) to be detached from the pinching block plates (3), or may cause the metal itself to deteriorate due to deformation beyond the elastic limit of the metal of the hooked clip (13). Therefore, a stretch function-added loading sheet will now be described, which uses a stopper-attached hooked clip (291) as the pinching jig to suppress excessive opening of the clip-opening width (17) of the hooked clip (13). FIG. 8A shows an assembly view of the stopper-attached hooked clip (291) used for the stretch function-added loading sheet of the third embodiment, and FIG. 8B shows a completion view.

FIG. 8A shows the assembly view of the stopper-attached hooked clip (291). One stopper-attached hooked clip (291) is composed of one clip stopper (31), one perforated hooked clip (30), two screws (32), and two nuts (36). The clip stopper (31) is attached from above the perforated hooked clip (30) with the two screws (32).

The clip stopper (31) has a structure including a stopper upper wall (34) in which two screw-insertion holes (33) are provided, and a pair of opposing symmetrical stopper side walls (35) that are fixed at both ends of the stopper upper wall (34). The clip stopper (31) is more rigid than the perforated hooked clip (30). For example, the clip stopper (31) can be made of a metal plate that is thicker than the metal plate that forms the perforated hooked clip (30).

The perforated hooked clip (30) is one in which two screw-insertion holes (33) are provided in the clip upper wall (14) of the hooked clip (13) described in the first embodiment in the positions corresponding to the two screw-insertion holes (33) of the stopper upper wall (34). The details of the perforated hooked clip (30) are the same as the hooked clip (13) described in the first embodiment, except that the screw-insertion holes (33) are provided, and thus the explanations will not be repeated.

The clip stopper (31) is placed over the perforated hooked clip (30), and the two screw-insertion holes (33) of the perforated hooked clip (30) are matched with the two screw-insertion holes (33) of the clip stopper (31), which the two screws (32) are passed through, and the screws (32) are fixed with the nuts (36). The stopper-attached hooked clip (291) is thus completed as shown in FIG. 8B.

The stretch function-added loading sheet of the third embodiment may be the same as the descriptions of the stretch function-added loading sheets of the first and second embodiments, except that the stopper-attached hooked, clip (291) is used as the pinching jig.

The stopper-attached hooked clip (291) has a mechanism that, when the clip-opening width (17) of the perforated hooked clip (30) increases by the clip-opening force (16) shown in FIG. 3C, the clip side walls (15) come into contact with the stopper side walls (35) of the clip stopper (31) before the clip opening width (17) reaches the width that would cause a problem, so as to suppress a further increase of the clip opening width (17). Therefore, the stopper opening width (37) of the clip stopper (31) is set to the stopper opening width (37) that corresponds to the value smaller than the clip-opening width (17) which may cause a problem. The rigidity of the clip stopper (31) is designed so as to be capable of exerting a stopper function against the clip-opening force (16) caused by the maximum predicted load when the sheet body (1) with the forced crimping units (2) placed thereon is in use. This stopper-attached hooked clip (291) is used instead of the hooked clip (13) that is a component of the forced crimping unit (2), so that the stretch function-added loading sheet is completed, which is equipped with the forced crimping unit (2) which suppresses abrupt excessive widening of the clip-opening width (17) of the stopper-attached hooked clip (291).

Figure 9A:
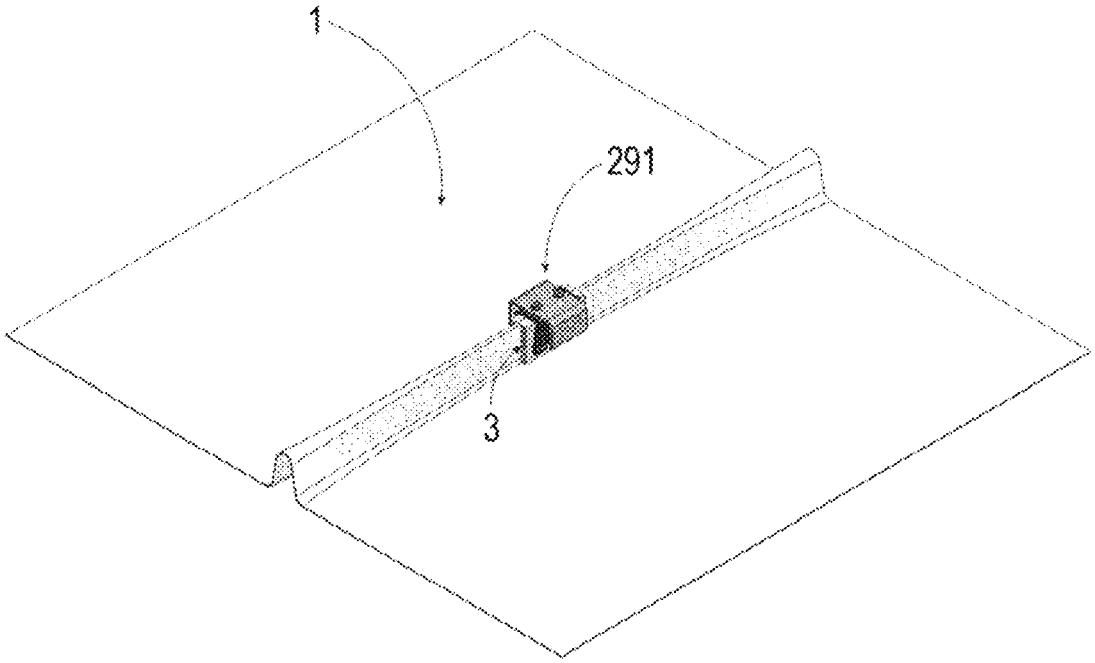
FIG. 9A is a perspective view of the stretch function-added loading sheet of the third embodiment of the present invention.
Figure 9B:
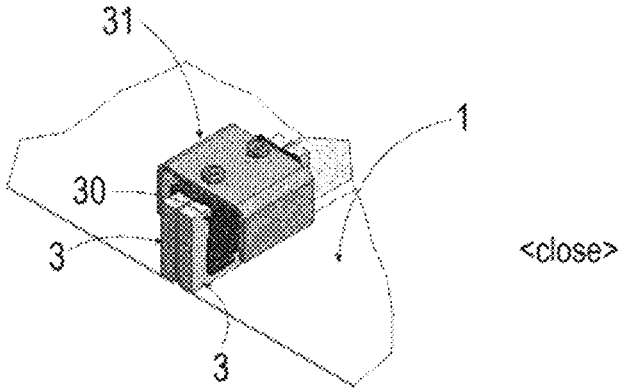
FIG. 9B is an explanatory view showing the stopper-attached hooked clip in a closed state in the stretch function-added loading sheet of FIG. 9A.
Figure 9C:
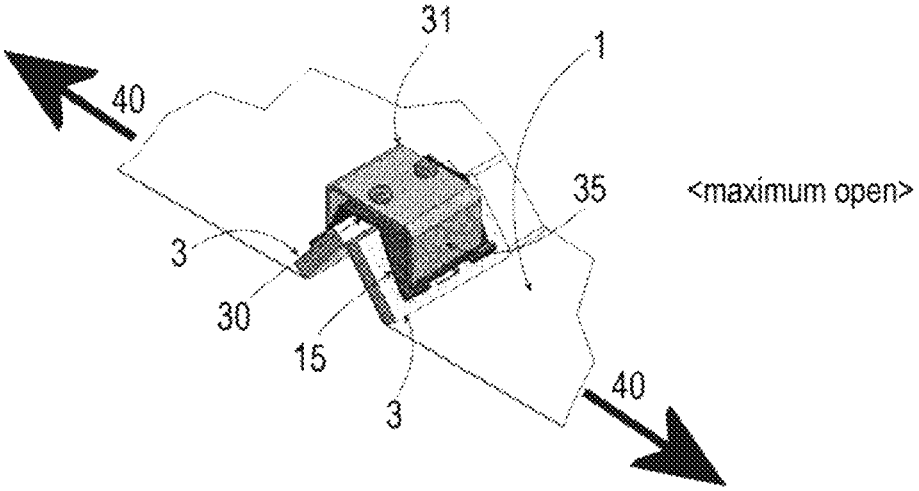
FIG. 9C is an explanatory view showing the stopper-attached hooked clip in an opened state in the stretch function-added loading sheet of FIG. 9A.

FIG. 9A illustrates a view in which the sheet body (1) equipped with the one forced crimping unit (2) using the stopper-attached hooked clip (291) shown in FIG. 8B as a component of the forced crimping unit (2), that is, the stretch function-added loading sheet of the third embodiment is completed. FIG. 9B illustrates the cross-section of the stretch function-added loading sheet of the third embodiment when no tensile force is applied. FIG. 9C illustrates the cross-section of the stretch function-added loading sheet of the third embodiment when the predicted maximum tensile force (40) is applied. In FIG. 9C, the clip side walls (15) of the perforated hooked clip (30) come into contact with the stopper side walls (35) of the clip stopper (31) so as to suppress a further increase of the clip-opening width (17) of the perforated hooked clip (30). It is thereby possible to suppress detachment of the perforated hooked clip (30) from the pinching block plates (3), and deterioration of the metal of the perforated hooked clip (30) due to deformation beyond the elastic limit. In addition, by designing the elasticity of opening/closing of the stopper side walls (35) of the clip stopper (31), only the elasticity of opening/closing of the clip side walls (15) of the perforated hooked clip (30) initially works during the transitional period in which the load exerted by the loaded object is applied, but after the clip side walls (15) and the stopper side wall (35) come into contact with each other as shown in FIG. 9C, the elasticity of opening/closing of the stopper side walls (35) is added, and therefore the elasticity in two levels can be designed, and the mitigation of shock to the loaded object can be further precisely performed.

A Fourth Embodiment

The stretch function-added loading sheet as a fourth embodiment is any of the stretch function-added loading sheets of the other embodiments, wherein:

the sheet body (1) is a fabric made of cotton;

the pinching block plates (3) is made of wood; and the sheet body (1) and the pinching block plates (3) are fixed by an adhesive containing an ethylene-vinyl acetate copolymer resin. The adhesive used in manufacturing the stretch function-added loading sheet may be an adhesive of which main component is an ethylene-vinyl acetate copolymer resin emulsion and of which solvent is water. The present embodiment is the same as the descriptions of the other embodiments, except those of the materials and the type of the adhesive.

The fabric made of cotton used as the material of the sheet body (1) includes canvas which is also used as a sheet material of conventional chairs and as a material of hammocks, as examples of commonly used products. Cotton, which is a natural plant fiber, has high fiber strength, low elongation, and moisture absorbency, and can be used as the sheet body (1) with sufficient load-bearing capacity against a load approximately of the weight of a person by increasing the thickness of the fabric by using twisted yarn or basket weaving. An adhesive containing an ethylene-vinyl acetate copolymer resin, which has excellent adhesion properties with the fabric made of cotton, is used as the adhesive for tightly fixing the pinching block plates (3). As the material of the pinching block plates (3), wood is used, which is a natural plant material having excellent adhesion properties with the ethylene-vinyl acetate copolymer resin.

This combination of the materials has advantages such as, when the target to be loaded is a person, securement of the load-bearing capacity, an improvement in comfort of the person, and low cost. Cotton fiber has high strength and low elongation, and thus, when a fabric made of cotton fiber is used as the sheet body (1), the elongation of the dimensions of the material itself due to load accumulation time is suppressed, which makes it a suitable material for the sheet body (1). Cotton fiber has high moisture absorbency, in a case when the target to be loaded is a person and the climate is warm, the sweat of the person will be absorbed, and the comfort of the person will be improved. In addition, it is possible to reduce the cost of cotton products. Unlike airtight sheets made of a polymeric resin, etc., fabrics have good air permeability. Adhesives containing an ethylene-vinyl acetate copolymer resin are used as typical adhesives for fabrics and wood. Cotton is a plant fiber itself, and wood is an aggregate of plant fibers, and thus it is considered that the water-soluble adhesive of which main component is an ethylene-vinyl acetate copolymer resin emulsion has adhesive properties that are similarly superior with respect to both the sheet body (1) made of cotton and the pinching block plates (3) made of wood.

A Fifth Embodiment

The chair pertaining to the embodiment of the present invention includes the stretch function-added loading sheet pertaining to the embodiments of the present invention as at least one of a seating surface and a backrest. The chair may be, for example, one including the stretch function-added loading sheet of the second embodiment as at least one of the seating surface and the backrest, and a structure body that supports the two fixing parallel frames of the stretch function-added loading sheet. The chair is preferably configured in such a manner that when a person is seated thereon, the two fixing parallel frames are placed in parallel on the left and right sides of the central plane of the person's trunk.

Figure 10A:
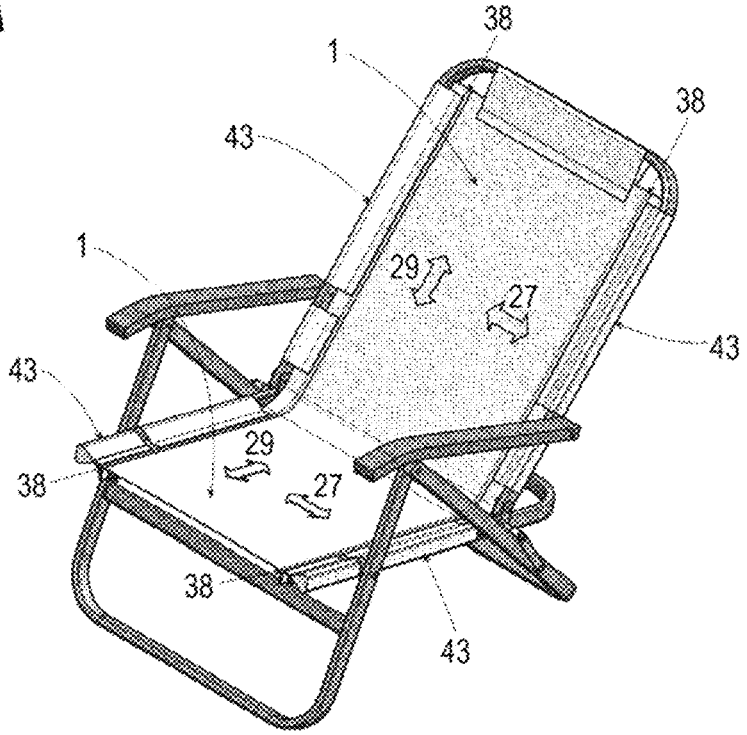
FIG. 10A is a perspective view of a chair of a fifth embodiment of the present invention.
Figure 10B:
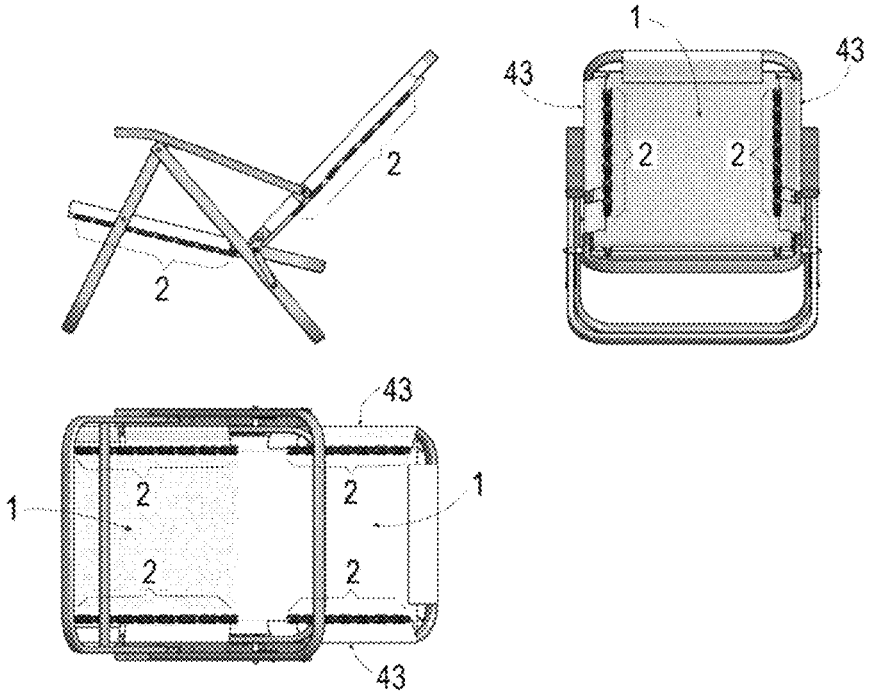
FIG. 10B is a three-plane drawing of the chair of FIG. 10A.

The chair of FIGS. 10A and 10B uses, for the seating surface and the backrest, the stretch function-added loading sheet on which a plurality of forced crimping units is placed in two rows in a parallel manner at both ends, which is similar to the one shown as the second embodiment. In FIG. 10A, two crimp grooves (38), which are parallel to the sheet length direction (29), are located at both ends in the sheet width direction (27) of the sheet body (1), which constitutes the seating surface and backrest of the chair, and the two crimp grooves (38) extend from the top end to the bottom end. FIG. 10B illustrates that, on the back sides of the two crimp grooves (38), the forced crimping units (2) forming said grooves are placed, eight of which are placed on the seating surface side and seven of which are placed on the backrest side in one row.

Figure 10C:
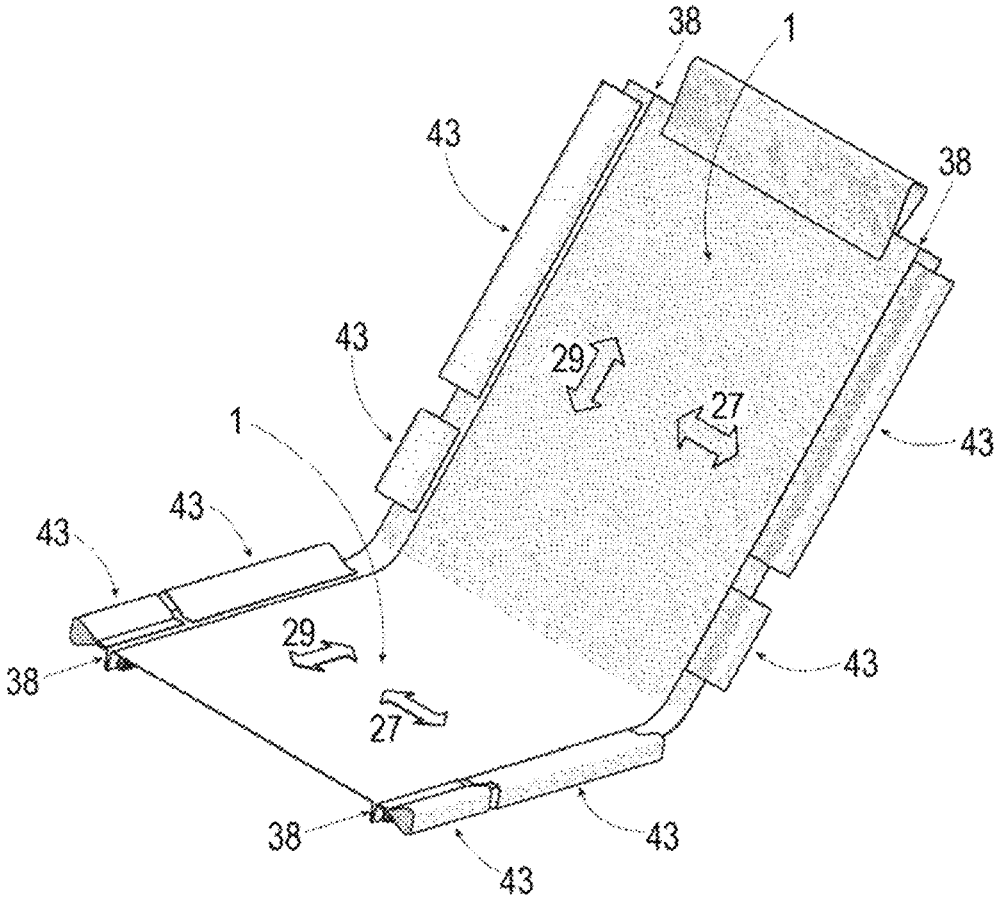
FIG. 10C is a perspective view showing a sheet body, etc. of the chair of FIG. 10A.
Figure 10D:
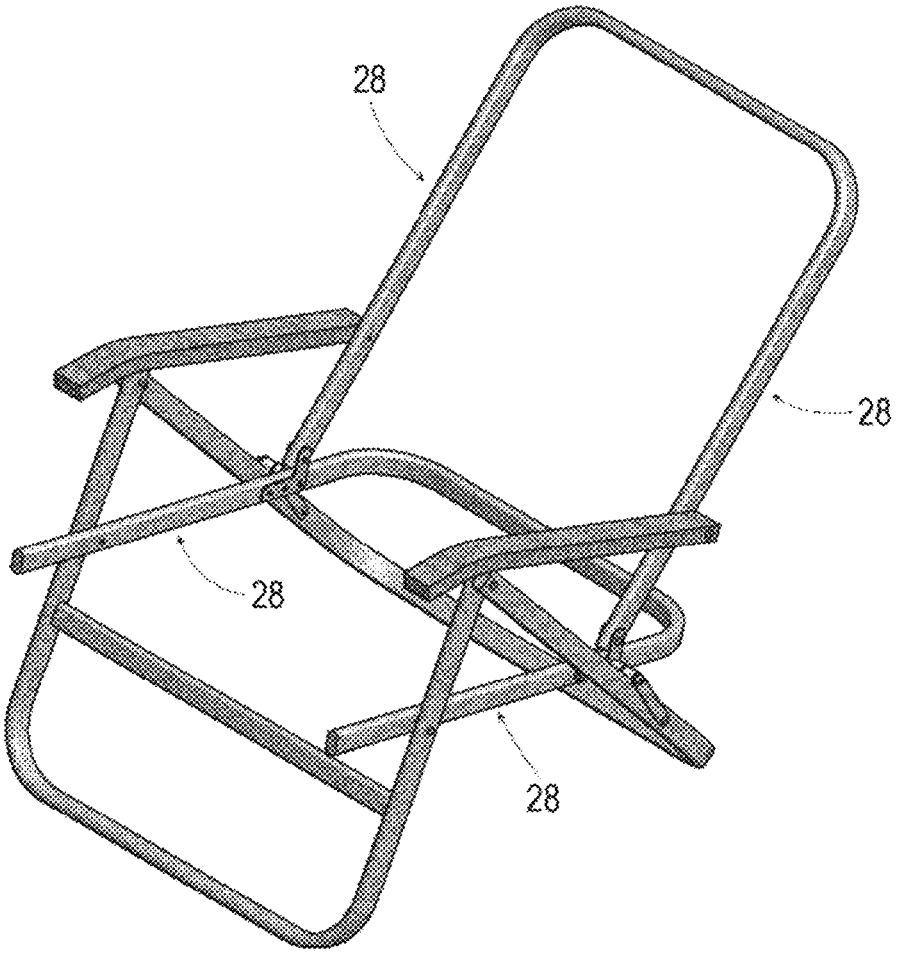
FIG. 10D is a perspective view showing a frame, etc. of the chair of FIG. 10A.

FIG. 10C illustrates the sheet body (1), etc. of the chair shown in FIGS. 10A and 10B. FIG. 10D illustrates the frames, etc., to which the sheet body (1), etc., is attached. The sheet body (1) is attached to the fixing parallel frames (28) by passing a total of four fixing parallel frames (28), each fixed to both left and right ends of the frames shown in FIG. 10D in positions corresponding to the seating surface as well as both left and right ends of the frames in positions corresponding to the backrest, through the sheet edge tubes (43) attached to both left and right edges of the sheet body (1) in the sheet width direction (27).

A Sixth Embodiment

Figure 11A:
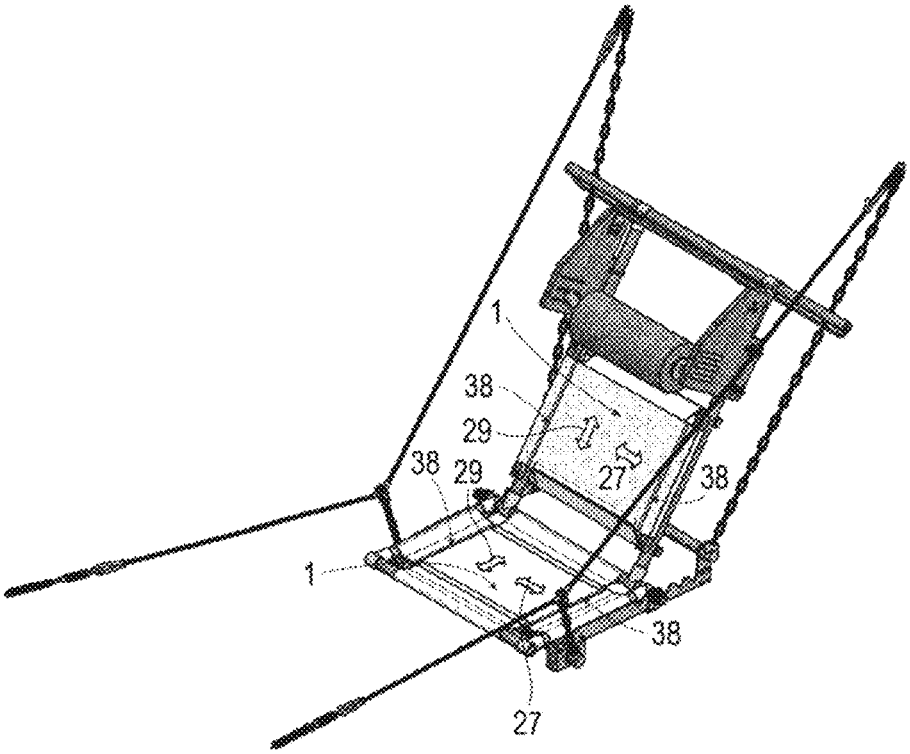
FIG. 11A is a perspective view showing a chair of a sixth embodiment of the present invention.
Figure 11B:
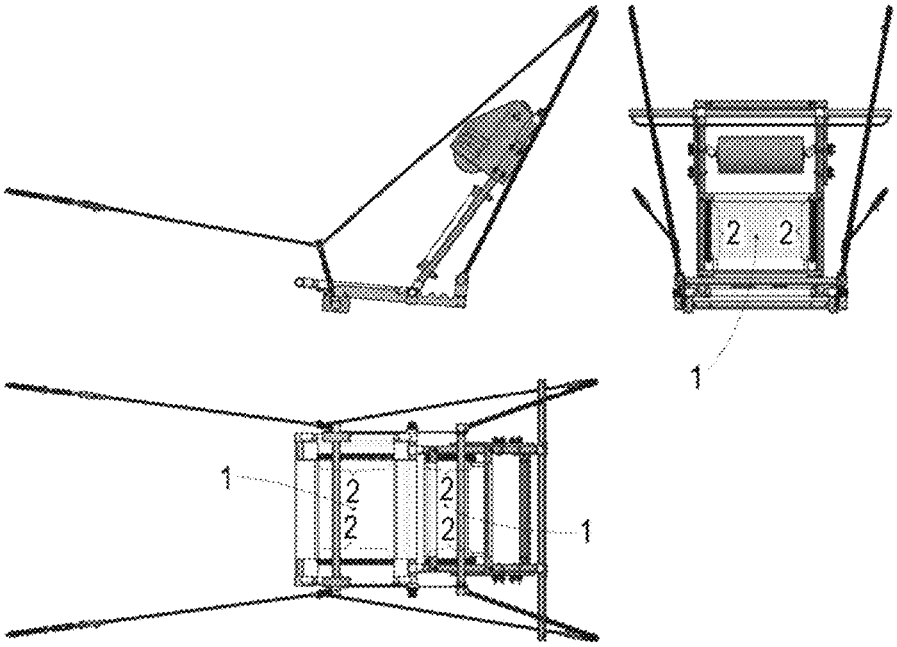
FIG. 11B is a three-plane drawing of the chair of FIG. 11A.

FIGS. 11A and 11B illustrate a chair pertaining to a sixth embodiment of the present invention in which, for the seating surface and the backrest of a hanging-type chair, there is used the stretch function-added loading sheet on which a plurality of forced crimping units is placed in two rows in a parallel manner at both ends, which is similar to the one shown as the second embodiment. In FIG. 11A, two crimp grooves (38), which are parallel to the sheet length direction (29), are located at both ends in the sheet width direction (27) of the sheet body (1) of the seating surface, and extend in straight lines from the back end to the front end. The backrest also includes two crimp grooves (38) parallel to the sheet length direction (29) which are located at both ends in the sheet width direction (27) of the sheet body (1) and extend in straight lines from the top end to the bottom end. FIG. 11B illustrates that, on the back sides of the two crimp grooves (38) of the seating surface and the backrest, the forced crimping units (2) forming said grooves are placed, seven of which are placed on the seating surface and six of which are placed on the backrest in one row, respectively.

Figure 12A:
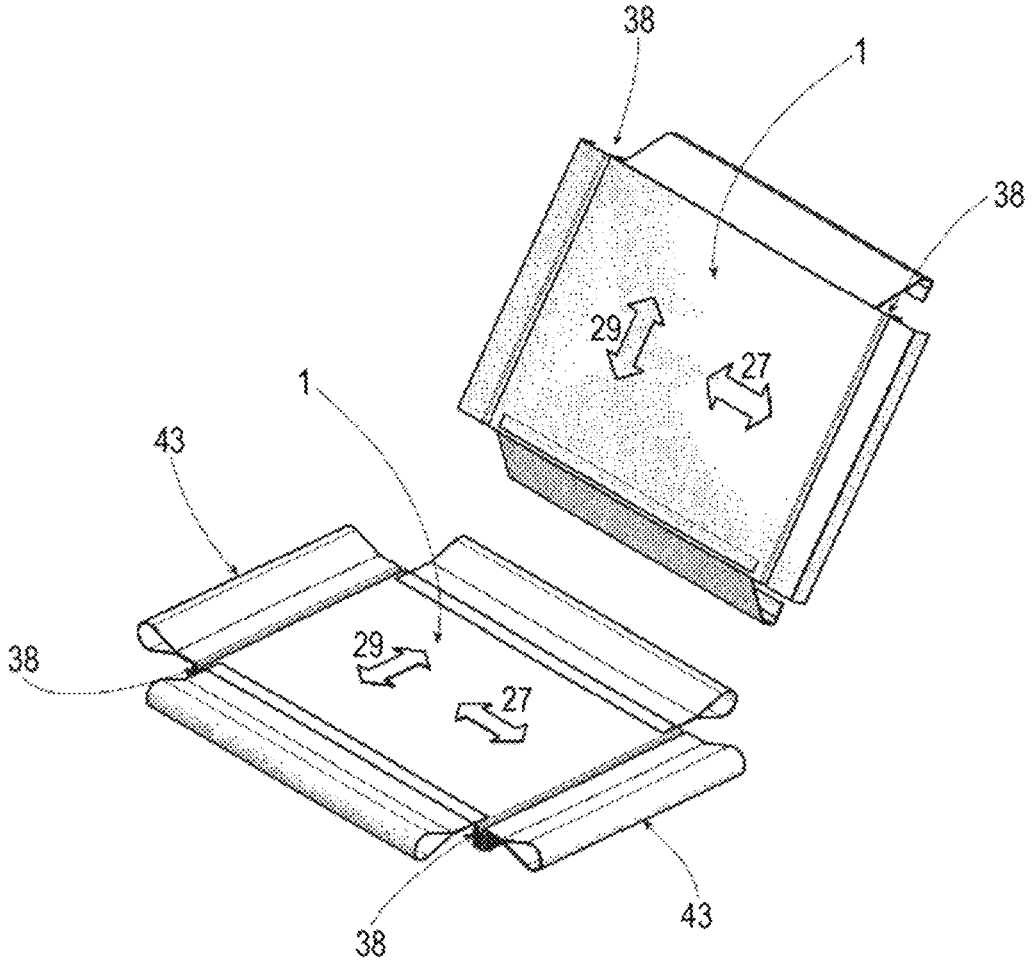
FIG. 12A is a perspective view showing a sheet body, etc. of the chair of FIG. 11A.
Figure 12B:
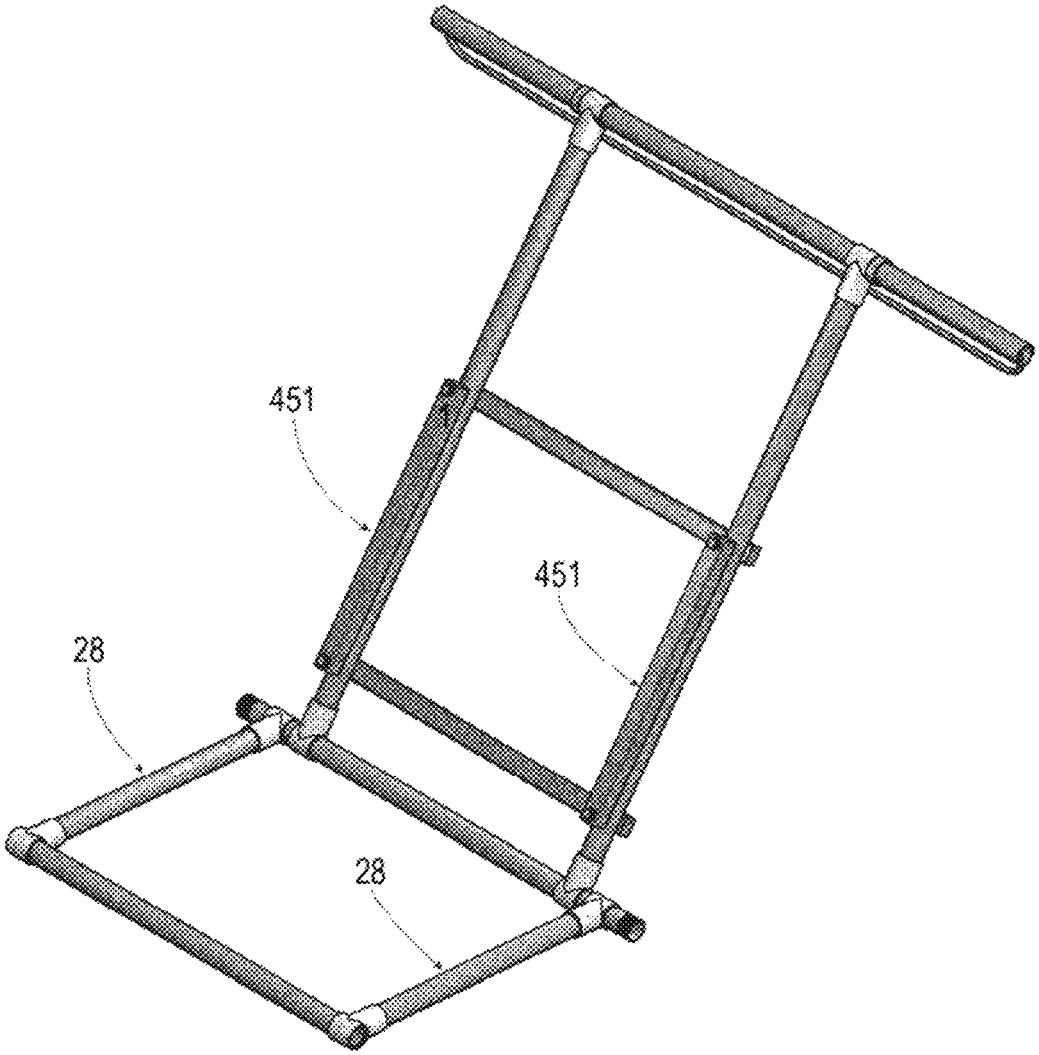
FIG. 12B is a perspective view showing a frame, etc. of the chair of FIG. 11A.

FIG. 12A illustrates the sheet body (1), etc. of the hanging-type chair shown in FIGS. 11A and 11B. In addition, the frames to which the sheet body (1), etc. are attached are shown in FIG. 12B. The seating surface is attached by inserting the left and right fixing parallel frames (28) through the sheet edge tubes (43) attached to the left and right edges in the sheet width direction (27) of the sheet body (1). The backrest is assembled by driving staples, etc. through the left and right end portions in the sheet width direction (27) of the sheet body (1) into the left and right wooden fixing parallel frames (451).

A Seventh Embodiment

As a seventh embodiment, a stretch function-added loading sheet will now be described, which uses a stopper band (45) as a means for suppressing excessive opening of the clip-opening width (17) of the hooked clip (13) besides the above-described third embodiment.

Figure 13A:
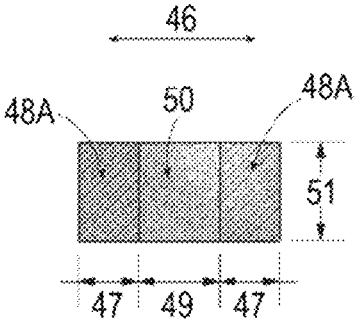
FIG. 13A is a top view of a stopper band used for a stretch function-added loading sheet of a seventh embodiment of the present invention.
Figure 13B:
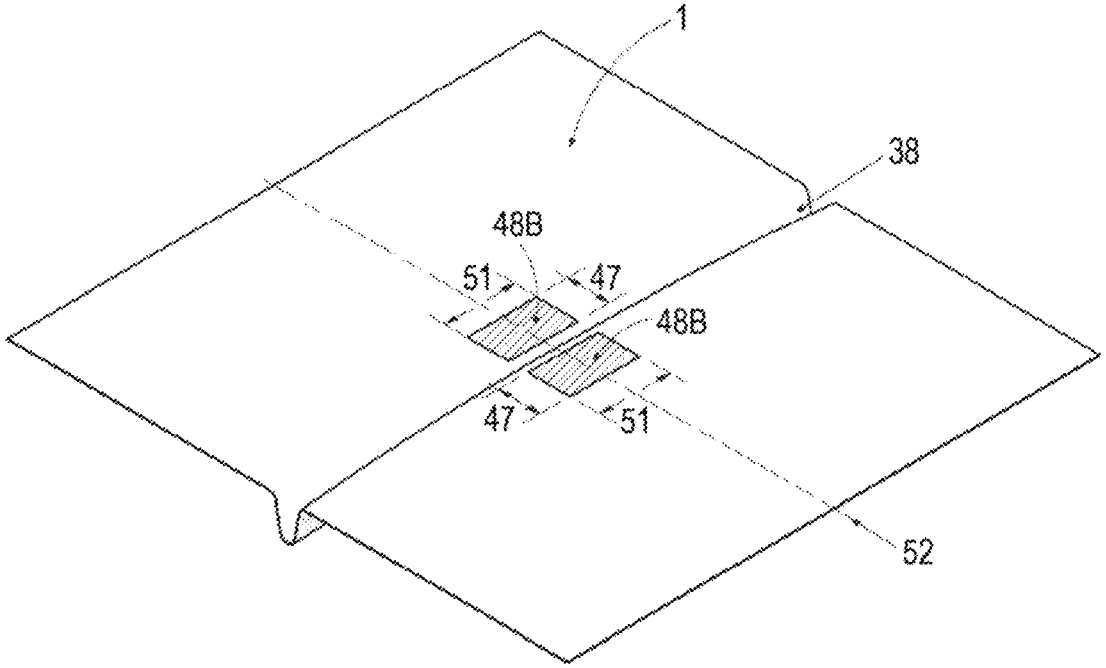
FIG. 13B is a perspective view showing tight attachment regions for the stopper band in the sheet body of the stretch function-added loading sheet of the first embodiment.
Figure 13C:
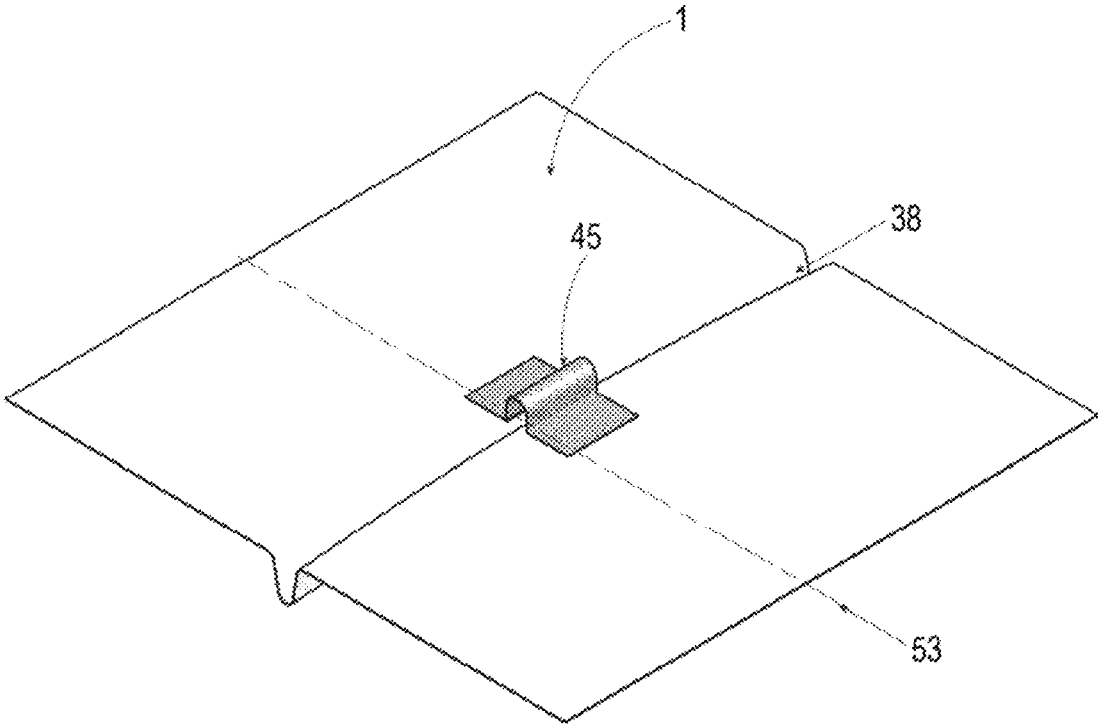
FIG. 13C is a perspective view showing the stretch function-added loading sheet of the seventh embodiment in which the stopper band is placed on the stretch function-added loading sheet of the first embodiment.

The stopper band (45) is a rectangular flexible sheet as shown in FIG. 13A, which is divided into three regions with respect to a perpendicular corresponding direction to the folding centerline (46). The regions in both end portions of the perpendicular corresponding direction to the folding centerline (46) are tight attachment regions (48A) having a tight attachment width (47), and the region sandwiched between the tight attachment regions (48A) is a variable curvature region (50) having a variable curvature width (49). The entire stopper band (45) is a rectangle having an area of a band length (51)×(the variable curvature width (49)+the tight attachment width (47)×2). FIG. 13B is a view showing a turned-over state of the sheet body (1) on which one completed forced crimping unit (2) in the same state as in FIG. 1C (Step 3) is placed thereon. FIG. 13B illustrates the state in which the forced crimping unit (2) cannot be seen as being hidden behind the sheet body (1) while one crimp groove (38) can be seen. As shown in FIG. 1C (Step 3), the forced crimping unit centerline (52) is an imaginary straight line which is drawn on the sheet body (1) to be perpendicular to the folding centerline (12) while passing through the center position of the clip width (25) of the hooked clip (13) that is a component of the forced crimping unit (2). Rectangular tight attachment regions (48B) are defined on the sheet body (1), which are located to be symmetrical with respect to the crimp groove (38), and each have an area of the band length (51)×the tight attachment width (47). The tight attachment regions (48B) are located in such a manner that each edge along the band length (51) of the tight attachment regions (48B) on the sheet body (1) is parallel to the crimp groove (38), and that the forced crimping unit centerline (52) passes through the center of the edge along the hand length (51). A pair of tight attachment regions (48A) of the stopper band (45) and a pair of tight attachment regions (48B) of the sheet body (1) have the same area, and the pair of tight attachment regions (48A) of the stopper band (45) and the pair of tight attachment regions (48B) of the sheet body (1) are tightly fixed as shown in FIG. 13C. In this way, the stopper band (45) is placed on the surface of the sheet body (1) opposite to the surface on which the forced crimping unit (2) is placed, and both end portions of the stopper band (45) (the pair of tight attachment regions (48A)) are tightly fixed to the sheet body (1) on both sides of the folding centerline (12), respectively. When the material of the sheet body (1) and the stopper band (45) is cloth, sewing can be used as a method of tightly attaching and fixing the tight attachment regions (48A) of the stopper band (45) to the tight attachment regions (48B) of the sheet body (1).

Figure 14A:
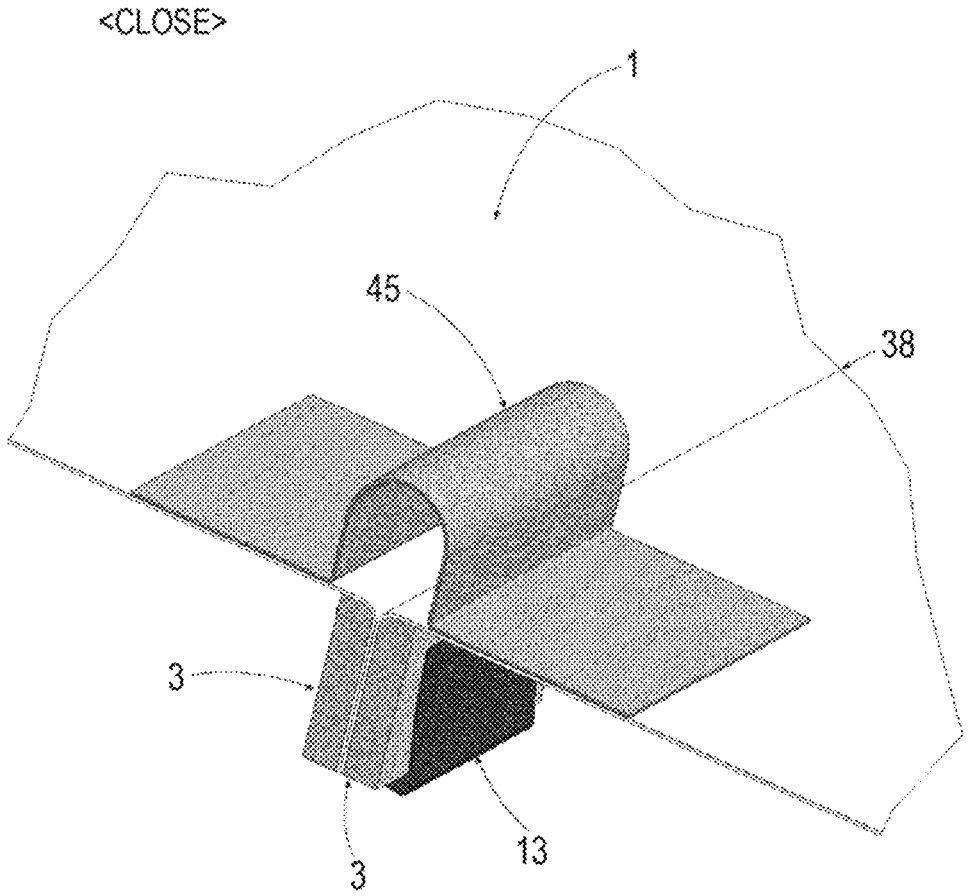
FIG. 14A is a partial cutaway view of the stretch function-added loading sheet of FIG. 13C.
Figure 14B:
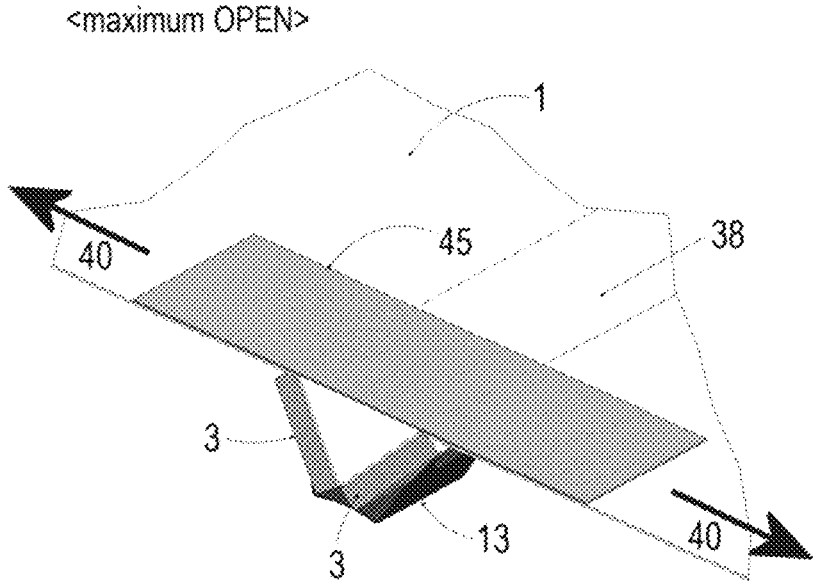
FIG. 14B is a partial cutaway view showing the state in which a tensile force is applied to the stretch function-added loading sheet of FIG. 13C.

FIG. 14A is a partial cutaway view in which the sheet body (1) is vertically cut along a cutting line (53) on the sheet body (1) shown in FIG. 13C. As no force is applied to the sheet body (1), it is in a state in which the hooked clip (13) is closed and the two pinching block plates (3) overlap each other, and the variable curvature region (50) of the stopper band (45) is curved. At this time, the variable curvature region (50) may be bent. FIG. 14B illustrates a state in which the maximum predicted tensile force (40) is applied from the above-mentioned state. As the tensile force (40) gradually increases from zero, the hooked clip (13) gradually opens, and the curvature of the variable curvature region (50) of the stopper band (45) gradually decreases. The opening of the hooked clip (13) stops when the tensile force (40) becomes equal to or greater than a predetermined magnitude and the variable curvature region (50) is fully extended and becomes flat (FIG. 14B). The maximum opening width of the hooked clip (13) is determined by the variable curvature width (49) of the stopper band (45). Therefore, the variable curvature width (49) of the stopper band (45) is designed so that the hooked clip (13) would not be detached from the pinching block plates (3), or the opening width of the hooked clip (13) would not reach the width that would cause deterioration of the metal due to deformation of the metal of the hooked clip (13) beyond its elastic limit. The stopper band (45) can be designed to entirely cover the crimp groove (38), and thus can also have a function of preventing foreign matters from entering the crimp groove (38).

An Eighth Embodiment

Figure 15A:
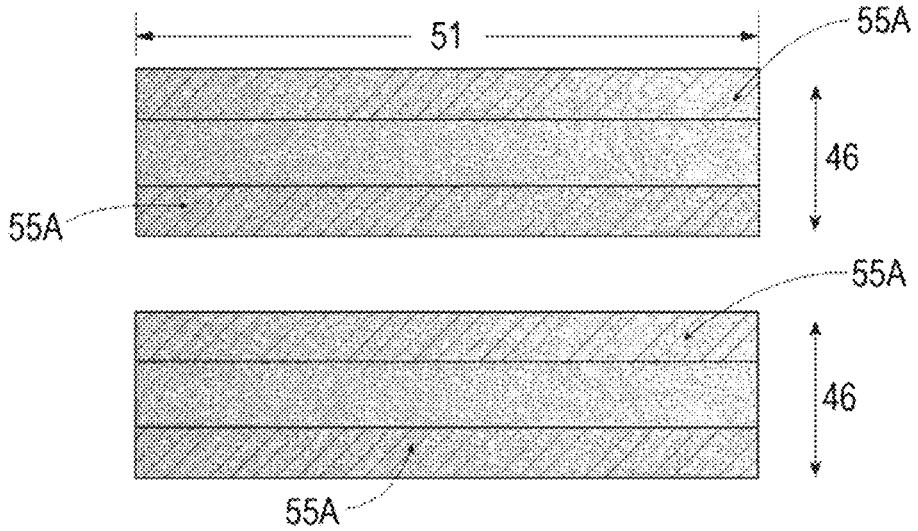
FIG. 15A is a top view showing connecting stopper bands used for a stretch function-added loading sheet of an eighth embodiment of the present invention.
Figure 15B:
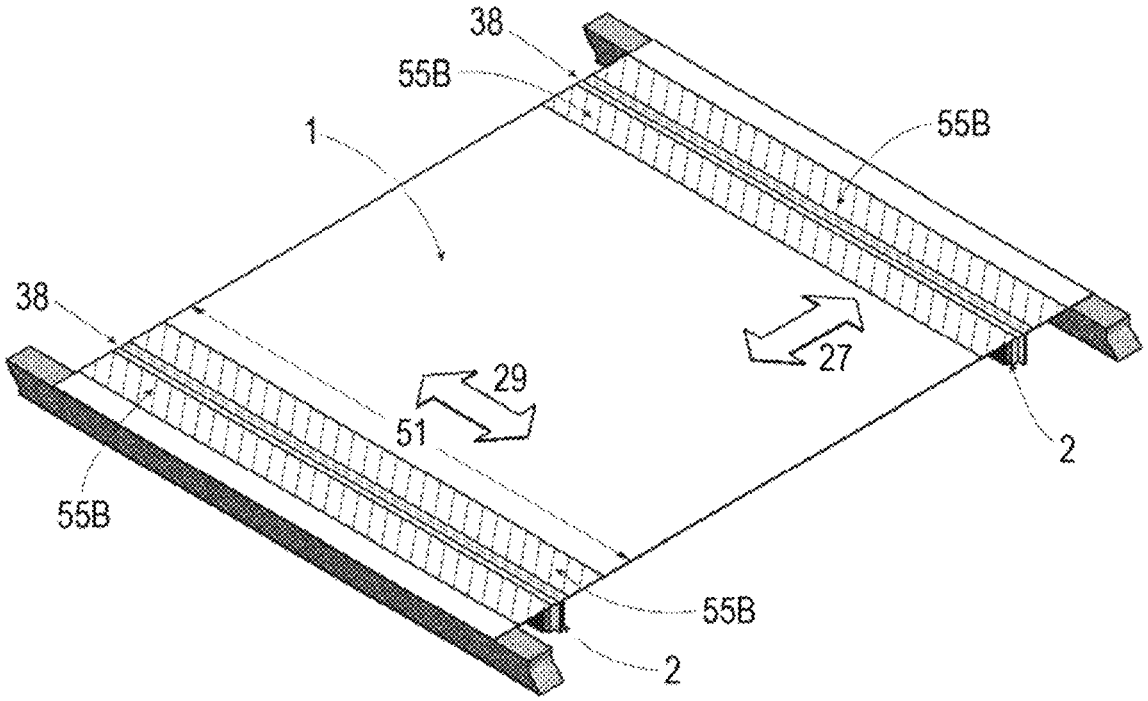
FIG. 15B is a perspective view showing tight attachment regions for the stopper bands in the sheet body of the stretch function-added loading sheet of the second embodiment.
Figure 15C:
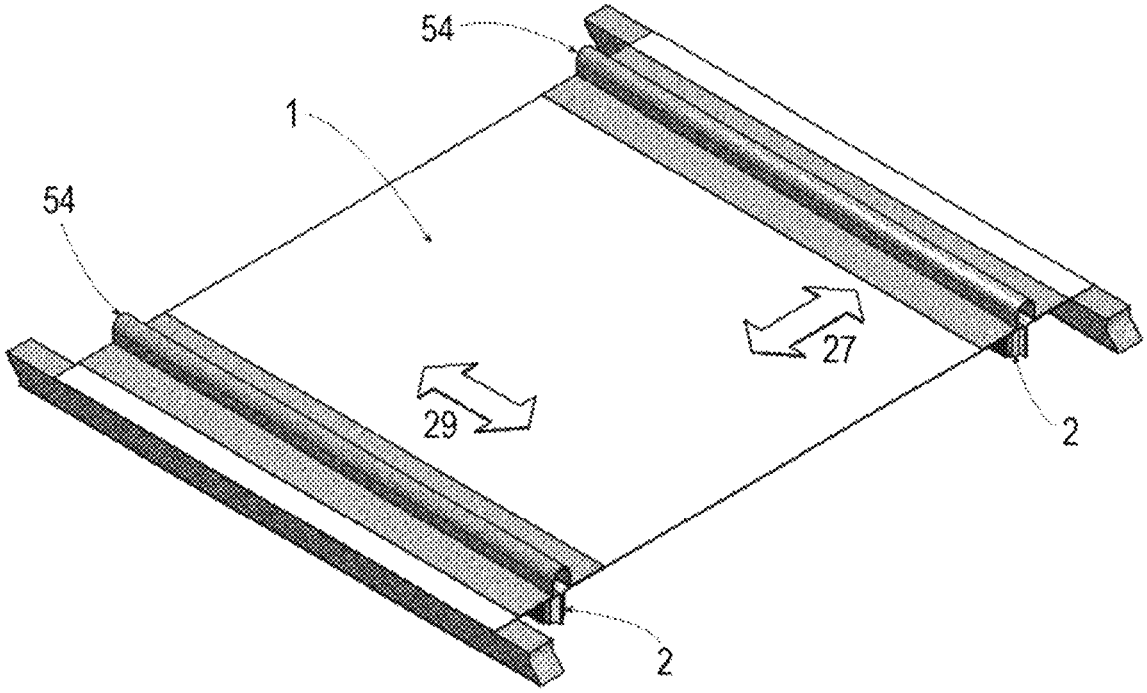
FIG. 15C is a perspective view showing the stretch function-added loading sheet of the eighth embodiment in which the stopper bands are placed on the stretch function-added loading sheet of the second embodiment.

As the stretch function-added loading sheet of the second embodiment shown in FIG. 5D, when the stopper band is used for a stretch function-added loading sheet on which a plurality of forced crimping units (2) is set on the common folding centerline (44), a stopper band (54) (connecting stopper band) can be used, which is in a form in which stopper bands set the respective forced crimping units (2) are connected to each other. It is thereby possible to control, with respect to the plurality of forced crimping units (2), the maximum opening width of each of the hooked clips (13) by one stopper band (54). FIGS. 15A to 15C illustrate an example of using the stopper band (54) for the stretch function added loading sheet of the second embodiment. FIG. 15A illustrates two stopper bands (54). Compared to the stopper band (45) of FIG. 13A, the band length (51) of the stopper band (54) of FIG. 15A is required to cover a plurality of forced crimping units (2) and thus made long correspondingly, and the regions to be tightly attached to the sheet body (1) are also long tight attachment regions (55A). FIG. 15B is a view showing the turned-over state of the stretch function-added loading sheet of the second embodiment in the state shown in FIG. 5D, Each pair of elongated rectangular tight attachment regions (55B), which correspond to the tight attachment regions (55A) of the stopper band (54) shown in FIG. 15A, is located in the same way as in FIG. 13B with respect to a pair of crimp grooves (38) located at both ends in the sheet width direction (27) of the sheet body (1). The two stopper bands (54) shown in FIG. 15A are used for the pair of crimp grooves (38), respectively, and in the same way as in FIG. 13C, the pair of tight attachment regions (55A) of the stopper band (54) and the pair of tight attachment regions (55B) of the sheet body (1) are tightly fixed along each of the crimp grooves (38), so that the setting of the stopper bands (54) of the second embodiment is completed as shown in FIG. 15C.

A Ninth Embodiment

Figure 16A:
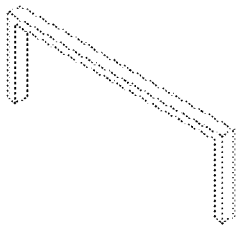
FIG. 16A is a perspective view showing a staple used for a stretch function-added loading sheet of a ninth embodiment of the present invention.
Figure 16B:
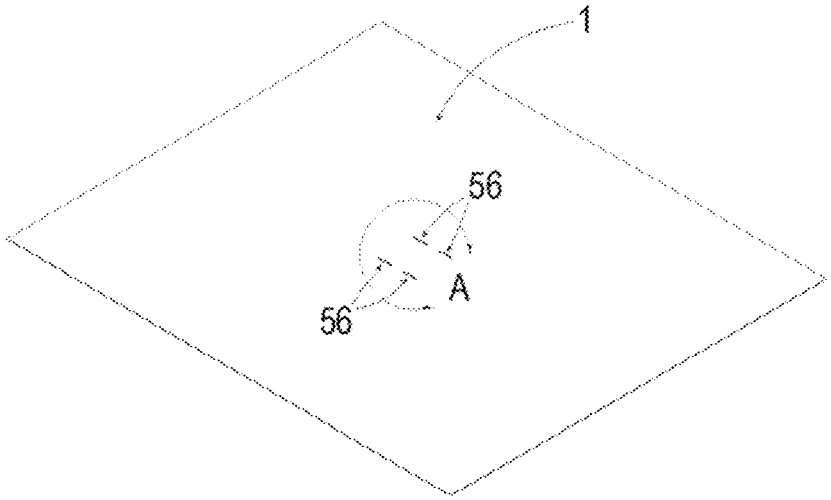
FIG. 16B is a perspective view showing a middle stage of assembling the stretch function-added loading sheet of the ninth embodiment.
Figure 16C:
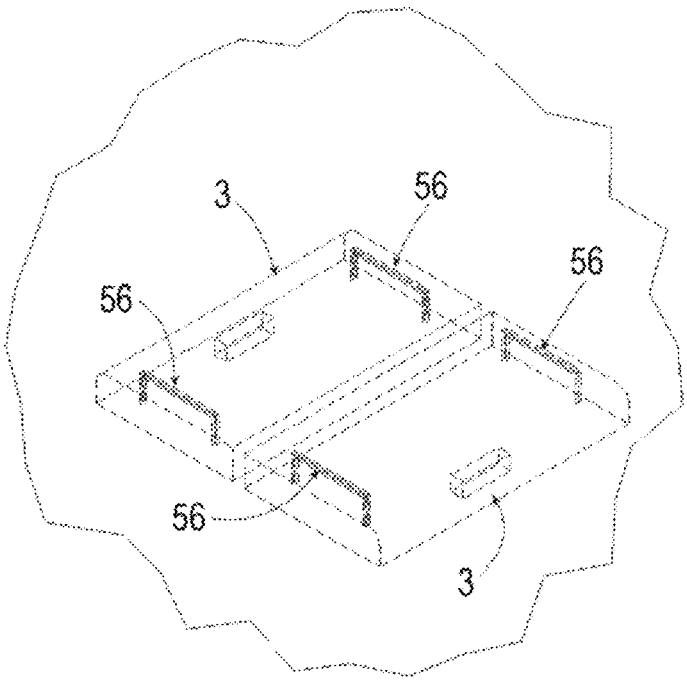
FIG. 16C is an enlarged view showing the staple mounted portions shown in FIG. 16B using hidden lines.

As a ninth embodiment, an embodiment of reinforcing the adhesion between the sheet body (1) and the pinching block plates (3) by means of staples (56) will be shown. When the material of the pinching block plates (3) is wood and the method of tightly fixing the sheet body (1) and the pinching block plates (3) is the tight fixation by means of an adhesive, a metal staple (56) shown in FIG. 16A can be used to reinforce the adhesion, FIG. 16B illustrates that the sheet body (1) in the state of FIG. 1A (Step 1) is turned over, and four staples (56) are driven into the pinching block plates (3) from above the sheet body (1). Since the pinching block plates (3) cannot be seen as being hidden behind the sheet body (1), the enlarged view A of FIG. 16C shows the pinching block plates (3), etc. using hidden lines. Here, one staple (56) is driven into each of the left and right positions of each of the pinching block plates (3).

Other Embodiments

The present invention is not limited to the above-mentioned embodiments, and various modifications may be added within the scope that would not deviate from the gist of the present invention. For example, to the configuration of one of the embodiments, the configuration of the other one of the embodiments can be added, or a part of the configuration of one of the embodiments can be replaced with the configuration of the other one of the embodiments or with a well-known technique. Furthermore, a part of the configuration of one of the embodiments can be removed, in addition, a well-known technique can be added to the configuration of one of the embodiments.

For example, the pinching jig constituting the forced crimping unit may be a clip such as the above-mentioned hooked clip, the stopper-attached hooked clip, etc., and further, may be anything other than a clip as long as it has a similar function. Moreover, the two pinching block plates constituting one forced crimping unit neither necessarily have the same shape, nor do they have to be symmetrically situated with respect to the folding centerline on the sheet body, as long as they are fixed on both sides of the folding centerline. The pinching, jig may be fixed to the pinching block plates by any means other than a hook structure.

Moreover, each embodiment of the following [1] to [4] also falls within the scope of the present invention.

[1]: A stretch function-added loading sheet comprising one load-bearing sheet and any number of forced crimping units, wherein:

the forced crimping unit is composed of two pinching block plates having the same shape and one hooked clip;

each of the pinching block plates is a rectangular plate having a block thickness, and a clip-fixing notch is provided in one surface of the plate in such a manner that the center of the notch length is aligned with the position of a block plate longitudinal centerline; the hooked clip is configured in such a manner that: one rectangular metal plate is bent to form a U-shape made up of a clip upper wall and a pair of symmetrical clip side walls connected to the both ends of the clip upper wall; the clip upper wall and each of the opposing clip side walls are made to form an acute angle therebetween so that ends of the opposing clip side walls are in contact with each other so as to be in a closed state; an opened state of the opposing clip side walls caused by elastic deformation of metal is enabled by an application of a clip-opening force in a direction to the outside of each of the clip side walls; and fixing hooks are attached, formed by bending distal ends of the left and right clip side walls inward each at a right angle;

the two pinching block plates of the forced crimping unit are tightly fixed to the load-bearing sheet by any method in such a manner that the surfaces opposite to the surfaces having the clip-fixing notches face the load-bearing sheet and that the two pinching block plates are situated to be symmetrical and parallel to a folding centerline on the load-bearing sheet with the clip-fixing notches being located outer sides, and after the load-bearing sheet is folded along the folding centerline in such a manner that the two pinching block plates overlap each other with the load-bearing sheet interposed therebetween, the hooked clip in an opened state so as to sandwich the two pinching block plates is attached, and when doing so, the fixing hooks of the hooked clip are fitted in the clip-fixing notches in the pinching block plates so that the one forced crimping unit is completed; and by placing the one forced crimping unit on the load-bearing sheet as thus described, the stretch function is achieved, which has elasticity exerted such that by an application of a tensile force in a direction perpendicular to the folding centerline to the portions of the load-bearing sheet located in the left and right perpendicular direction with respect to the folding centerline of the forced crimping unit, the clip side walls of the hooked clip opens so that the load-bearing sheet extends in the direction of the tensile force, while the sheet contracts when the tensile force is reduced; and any number of the forced crimping units is placed on said one load-bearing sheet in any position to complete the load-bearing sheet equipped with the forced crimping unit, which is fixed by any method and used such that art object to be loaded is placed on the load-bearing sheet,

[2]: The stretch function-added loading sheet of [1], comprising one load-bearing sheet, army even number of the forced crimping units, and two fixing parallel frames, wherein:

the load-bearing sheet has a rectangular shape, and two common folding centerlines that are parallel and symmetrical to the sheet width centerline are located, a half of the forced crimping units are attached in one row at equal intervals in such a manner that one of the common folding centerlines overlaps the folding centerline of each of the forced crimping units, and with respect to said placement of the forced crimping units, the remaining half of the forced crimping units are situated on the symmetrical positions with respect to the sheet width centerline so that the forced crimping units are attached in one row at equal intervals in such a manner that the other of the common folding centerlines overlaps each of the folding centerlines, and thereby the placement of the forced crimping units in two parallel rows at both ends of the load-bearing sheet is completed;

the two fixing parallel frames are fixed in any location by any method;

the left and right fixing parallel frames are fixed by any method, to be parallel to the sheet width centerline, respectively on the left and right spaces each located between one of the left and right edges in the sheet width direction of the load-bearing sheet on which the above-explained forced crimping units are placed in two parallel rows at both ends thereof, and one of the left and right rows of the forced crimping units; and an object to be loaded is placed between the two rows of forced crimping units when being used.

[3]: The stretch function-added loading sheet configured in such a manner that: the stopper-attached hooked clip is composed of one clip stopper, one perforated hooked clip, two screws, and two nuts;

the clip stopper is formed to have a U-shape composed of a stopper upper wall having two screw-insertion holes and a pair of symmetrical stopper side walls fixed to both ends of the stopper upper wall, and the perforated hooked clip is one in which two screw-insertion holes are formed through the clip upper wall of the hooked clip;

the clip stopper is placed over the perforated hooked clip, and the two screw-insertion holes are matched with the corresponding ones, and the screws are inserted therethrough and fixed with the nuts, so that the one stopper-attached hooked clip is completed; and all the hooked clips that are the constituent components of the stretch function-added loading sheet of [1] or [2] are replaced with the stopper-attached hooked clips.

[4]: The stretch function-added loading sheet of [2] or [3], wherein the load-bearing sheet and the pinching block plates, which are the components thereof, are configured in such a manner that:

a specific material of the load-bearing sheet is a fabric made of cotton; a specific material of the pinching block plates is wood; the method of tightly fixing the load-bearing sheet and the pinching block plates is fixation with an adhesive; and the main component of the adhesive is an ethylene-vinyl acetate copolymer resin emulsion, and the solvent is water.

DESCRIPTIONS OF REFERENCE NUMERALS

1. sheet body
2. forced crimping unit
3. pinching block plate
6. block thickness
7. notch length
10. clip-fixing notch
11. block plate longitudinal centerline
12. folding centerline
13. hooked clip (pinching jig)
14. clip upper wall
15. clip side wall
16. clip-opening force
19. fixing hook
26, sheet width centerline
27. sheet width direction
28. fixing parallel frame
291. stopper-attached hooked clip (pinching jig)
30. perforated hooked clip
31. clip stopper
32. screw
33. screw-insertion hole
34. stopper upper wall
35. stopper side wall
36. nut
40. tensile force
44. common folding centerline
45. stopper band
54. stopper band (connecting stopper band)

The invention claimed is:

1. A stretch function-added loading sheet, comprising one sheet body, and any number of forced crimping units, the forced crimping unit including two pinching block plates and one pinching jig, wherein:

the two pinching block plates are fixed on one surface of the sheet body on both sides of a folding centerline on the sheet body;

the pinching jig is fixed to the two pinching block plates so as to sandwich the two pinching block plates in a state where the sheet body is folded along the folding centerline in such a manner that the two pinching block plates overlap each other with the sheet body interposed therebetween; and the stretch function-added loading sheet has a stretch function in which the sheet body extends as the pinching jig opens by means of an opening/closing mechanism that the pinching jig has, which is caused by an application of a tensile force in a direction perpendicular to the folding centerline to the sheet body, while the sheet body contracts as the pinching jig closes by means of the opening/closing mechanism that the pinching jig has when the tensile force is reduced.

2. The stretch function-added loading sheet according to claim 1, wherein:

the two pinching block plates have the same shape;

each of the pinching block plates is a rectangular plate having a block thickness, and a clip-fixing notch is provided in one surface of this plate in such a manner that the center of a notch length is aligned with the position of a longitudinal centerline of the block plate;

the pinching jig is a hooked clip;

the hooked clip has a structure formed by bending one rectangular metal plate and including a clip upper wall and a pair of opposing clip side walls connected to both ends of the clip upper wall, and the hooked clip is configured to be in a closed state where distal ends of the pair of opposing clip side walls come close to each other, and a state where the pair of opposing clip side walls are opened due to elastic deformation of metal when a clip-opening force is applied in a direction to the outside of each of the pair of opposing clip side walls, which constitutes the opening/closing mechanism;

fixing hooks each bent inward at a right angle are formed each at each distal end of the pair of clip side walls;

the two pinching block plates are situated symmetrically with respect to the folding centerline in a state where surfaces opposite to the surfaces in which the clip-fixing notches are provided face the sheet body;

the sheet body is folded along the folding centerline in such a manner that the two pinching block plates overlap each other with the sheet body interposed therebetween, and the fixing hooks of the hooked clip are fitted in the clip-fixing notches of the pinching block plates in a state where the hooked clip in an opened state so as to sandwich the two pinching block plates is attached; and the stretch function-added loading sheet is secured by any method and used such that an object to be loaded is placed on the sheet body.

3. The stretch function-added loading sheet according to claim 2, further comprising a stopper band, which is a flexible sheet, placed on a surface of the sheet body opposite to the surface in which the forced crimping unit is placed, wherein:

both end portions of the stopper band are tightly fixed to the sheet body on both sides of the folding centerline, respectively; and the stopper band is placed such that the portion between both end portions of the stopper band is curved or bent in a state where the tensile force is not applied to the sheet body, and the portion between both end portions of the stopper band is flat-shaped in a state where the tensile force of a predetermined magnitude or greater is applied.

4. The stretch function-added loading sheet according to claim 3, wherein:

the sheet body is a fabric made of cotton;

the pinching block plates are made of wood; and the sheet body and the pinching block plates are fixed by an adhesive containing an ethylene-vinyl acetate copolymer resin.

5. The stretch function-added loading sheet according to claim 3, further comprising two fixing parallel frames, wherein:

the number of forced crimping units is even;

the sheet body has a rectangular shape, and two common folding centerlines that are parallel and symmetrical with respect to the sheet width centerline of the sheet body are located;

a half of the forced crimping units are attached in one row at equal intervals in such a manner that one of the common folding centerlines overlaps the folding centerline of each of the forced crimping units;

the remaining half of the forced crimping units are attached in one row at equal intervals in such a manner that the other of the common folding centerlines overlaps the folding centerline of each of the forced crimping units;

the half of the forced crimping units and the other half of the forced crimping units are symmetrically situated with respect to the sheet width centerline;

the two fixing parallel frames are attached to both end portions each located between each end edge of the sheet body in the sheet width direction and each of the rows of the forced crimping units, so as to be parallel to the sheet width centerline;

the two fixing parallel frames are fixed to any locations by any method; and the stretch function-added loading sheet is used such that an object to be loaded is placed between the two rows of the forced crimping units.

6. The stretch function-added loading sheet according to claim 5, wherein:

the sheet body is a fabric made of cotton;

the pinching block plates are made of wood; and the sheet body and the pinching block plates are fixed by an adhesive containing an ethylene-vinyl acetate copolymer resin.

7. The stretch function-added loading sheet according to claim 2, wherein:

the sheet body is a fabric made of cotton;

the pinching block plates are made of wood; and the sheet body and the pinching block plates are fixed by an adhesive containing an ethylene-vinyl acetate copolymer resin.

8. The stretch function-added loading sheet according to claim 2, further comprising two fixing parallel frames, wherein:

the number of forced crimping units is even;

the sheet body has a rectangular shape, and two common folding centerlines that are parallel and symmetrical with respect to the sheet width centerline of the sheet body are located;

a half of the forced crimping units are attached in one row at equal intervals in such a manner that one of the common folding centerlines overlaps the folding centerline of each of the forced crimping units;

the remaining half of the forced crimping units are attached in one row at equal intervals in such a manner that the other of the common folding centerlines overlaps the folding centerline of each of the forced crimping units;

the half of the forced crimping units and the other half of the forced crimping units are symmetrically situated with respect to the sheet width centerline;

the two fixing parallel frames are attached to both end portions each located between each end edge of the sheet body in the sheet width direction and each of the rows of the forced crimping units, so as to be parallel to the sheet width centerline;

the two fixing parallel frames are fixed to any locations by any method; and the stretch function-added loading sheet is used such that an object to be loaded is placed between the two rows of the forced crimping units.

9. The stretch function-added loading sheet according to claim 8, wherein:

the sheet body is a fabric made of cotton;

the pinching block plates are made of wood; and the sheet body and the pinching block plates are fixed by an adhesive containing an ethylene-vinyl acetate copolymer resin.

10. The stretch function-added loading sheet according to claim 1, wherein:

the two pinching block plates have the same shape;

each of the pinching block plates is a rectangular plate having a block thickness, and a clip-fixing notch is provided in one surface of this plate in such a manner that the center of a notch length is aligned with the position of a longitudinal centerline of the block plate;

the pinching jig is a stopper-attached hooked clip;

the stopper-attached hooked clip includes one clip stopper, one perforated hooked clip, two screws, and two nuts;

the clip stopper has a structure including a stopper upper wall in which two screw-insertion holes are provided, and a pair of opposing stopper side walls that are fixed at both ends of the stopper upper wall;

the perforated hooked clip has a structure formed by bending one rectangular metal plate and including a clip upper wall and a pair of opposing clip side walls connected to both ends of the clip upper wall, and the perforated hooked clip is configured to be in a closed state where distal ends of the pair of opposing clip side walls come close to each other, and a state where the pair of opposing clip side walls are opened due to elastic deformation of metal when a clip-opening force is applied in a direction to the outside of each of the pair of opposing clip side walls, which constitutes the opening/closing mechanism;

fixing hooks each bent inward at a right angle are formed each at each distal end of the pair of clip side walls;

the clip upper wall is provided with two screw-insertion holes;

the stopper-attached hooked clip has a structure in which the clip stopper is placed over the perforated hooked clip, and in a state where the two screw-insertion holes of the perforated hooked clip are matched with the two screw-insertion holes of the clip stopper, the screws are passed through the screw-insertion holes, respectively, and fixed with the nuts;

the two pinching block plates are situated symmetrically with respect to the folding centerline in a state where surfaces opposite to the surfaces in which the clip-fixing notches are provided face the sheet body;

the sheet body is folded along the folding centerline in such a manner that the two pinching block plates overlap each other with the sheet body interposed therebetween, and the fixing hooks of the stopper-attached hooked clip are fitted in the clip-fixing notches of the pinching block plates in a state where the stopper-attached hooked clip in an opened state so as to sandwich the two pinching block plates is attached; and the stretch function-added loading sheet is secured by any method and used such that an object to be loaded is placed on the sheet body.

11. The stretch function-added loading sheet according to claim 10, further comprising a stopper band, which is a flexible sheet, placed on a surface of the sheet body opposite to the surface in which the forced crimping unit is placed, wherein:

both end portions of the stopper band are tightly fixed to the sheet body on both sides of the folding centerline, respectively; and the stopper band is placed such that the portion between both end portions of the stopper band is curved or bent in a state where the tensile force is not applied to the sheet body, and the portion between both end portions of the stopper band is flat-shaped in a state where the tensile force of a predetermined magnitude or greater is applied.

12. The stretch function-added loading sheet according to claim 10, further comprising two fixing parallel frames, wherein:

the number of forced crimping units is even;

the sheet body has a rectangular shape, and two common folding centerlines that are parallel and symmetrical with respect to the sheet width centerline of the sheet body are located;

a half of the forced crimping units are attached in one row at equal intervals in such a manner that one of the common folding centerlines overlaps the folding centerline of each of the forced crimping units;

the remaining half of the forced crimping units are attached in one row at equal intervals in such a manner that the other of the common folding centerlines overlaps the folding centerline of each of the forced crimping units;

the half of the forced crimping units and the other half of the forced crimping units are symmetrically situated with respect to the sheet width centerline;

the two fixing parallel frames are attached to both end portions each located between each end edge of the sheet body in the sheet width direction and each of the rows of the forced crimping units, so as to be parallel to the sheet width centerline;

the two fixing parallel frames are fixed to any locations by any method; and the stretch function-added loading sheet is used such that an object to be loaded is placed between the two rows of the forced crimping units.

13. The stretch function-added loading sheet according to claim 1, further comprising a stopper band, which is a flexible sheet, placed on a surface of the sheet body opposite to the surface in which the forced crimping unit is placed, wherein:

both end portions of the stopper band are tightly fixed to the sheet body on both sides of the folding centerline, respectively; and the stopper band is placed such that the portion between both end portions of the stopper band is curved or bent in a state where the tensile force is not applied to the sheet body, and the portion between both end portions of the stopper band is flat-shaped in a state where the tensile force of a predetermined magnitude or greater is applied.

14. The stretch function-added loading sheet according to claim 13, further comprising two fixing parallel frames, wherein:

the number of forced crimping units is even;

the sheet body has a rectangular shape, and two common folding centerlines that are parallel and symmetrical with respect to the sheet width centerline of the sheet body are located;

a half of the forced crimping units are attached in one row at equal intervals in such a manner that one of the common folding centerlines overlaps the folding centerline of each of the forced crimping units;

the remaining half of the forced crimping units are attached in one row at equal intervals in such a manner that the other of the common folding centerlines overlaps the folding centerline of each of the forced crimping units;

the half of the forced crimping units and the other half of the forced crimping units are symmetrically situated with respect to the sheet width centerline;

the two fixing parallel frames are attached to both end portions each located between each end edge of the sheet body in the sheet width direction and each of the rows of the forced crimping units, so as to be parallel to the sheet width centerline;

the two fixing parallel frames are fixed to any locations by any method; and the stretch function-added loading sheet is used such that an object to be loaded is placed between the two rows of the forced crimping units.

15. The stretch function-added loading sheet according to claim 14, wherein:

the sheet body is a fabric made of cotton;

the pinching block plates are made of wood; and the sheet body and the pinching block plates are fixed by an adhesive containing an ethylene-vinyl acetate copolymer resin.

16. The stretch function-added loading sheet according to claim 13, wherein:

the sheet body is a fabric made of cotton;

the pinching block plates are made of wood; and the sheet body and the pinching block plates are fixed by an adhesive containing an ethylene-vinyl acetate copolymer resin.

17. The stretch function-added loading sheet according to claim 1, further comprising two fixing parallel frames, wherein:

the number of forced crimping units is even;

the sheet body has a rectangular shape, and two common folding centerlines that are parallel and symmetrical with respect to the sheet width centerline of the sheet body are located;

a half of the forced crimping units are attached in one row at equal intervals in such a manner that one of the common folding centerlines overlaps the folding centerline of each of the forced crimping units;

the remaining half of the forced crimping units are attached in one row at equal intervals in such a manner that the other of the common folding centerlines overlaps the folding centerline of each of the forced crimping units;

the half of the forced crimping units and the other half of the forced crimping units are symmetrically situated with respect to the sheet width centerline;

the two fixing parallel frames are attached to both end portions each located between each end edge of the sheet body in the sheet width direction and each of the rows of the forced crimping units, so as to be parallel to the sheet width centerline;

the two fixing parallel frames are fixed to any locations by any method; and the stretch function-added loading sheet is used such that an object to be loaded is placed between the two rows of the forced crimping units.

18. The stretch function-added loading sheet according to claim 17, wherein:

the sheet body is a fabric made of cotton;

the pinching block plates are made of wood; and the sheet body and the pinching block plates are fixed by an adhesive containing an ethylene-vinyl acetate copolymer resin.

19. The stretch function-added loading sheet according to claim 1, wherein:

the sheet body is a fabric made of cotton;

the pinching block plates are made of wood; and the sheet body and the pinching block plates are fixed by an adhesive containing an ethylene-vinyl acetate copolymer resin.

20. A chair comprising the stretch function-added loading sheet according to claim 1, as at least one of a seating surface and a backrest.

* * * * *